US007772510B2

(12) United States Patent
Manahan et al.

(10) Patent No.: US 7,772,510 B2
(45) Date of Patent: Aug. 10, 2010

(54) SYSTEM AND METHOD FOR ACTUATING ONE OR MORE SLIDERS

(75) Inventors: Joseph Michael Manahan, Manlius, NY (US); Clifford Randy Helmer, Fulton, NY (US)

(73) Assignee: Cooper Technologies Company, Houston, TX (US)

( * ) Notice: Subject to any disclaimer, the term of this patent is extended or adjusted under 35 U.S.C. 154(b) by 854 days.

(21) Appl. No.: 11/224,789

(22) Filed: Sep. 13, 2005

(65) Prior Publication Data

US 2007/0056835 A1 Mar. 15, 2007

(51) Int. Cl.
*H01H 9/20* (2006.01)

(52) U.S. Cl. ..... 200/50.02; 200/50.04

(58) Field of Classification Search ..... 200/50.02, 200/50.06, 50.18, 50.2, 330, 331, 329, 336
See application file for complete search history.

(56) References Cited

U.S. PATENT DOCUMENTS 4,031,340 A 6/1977 Pastorel
4,391,480 A 7/1983 Mina
4,553,000 A 11/1985 Appleton
4,620,061 A 10/1986 Appleton
4,965,414 A 10/1990 Sobotka, Jr. et al.
5,111,009 A * 5/1992 Chan et al. ..... 200/330
5,212,624 A 5/1993 Johnson et al.
5,286,935 A 2/1994 Mina et al.
5,288,958 A * 2/1994 Grunert et al. ..... 200/331
5,493,084 A * 2/1996 Whitaker et al. ..... 200/50.05
5,577,603 A 11/1996 Bogdanovs et al.
5,634,553 A * 6/1997 Hopper et al. ..... 200/336
5,661,265 A 8/1997 Yarbrough et al.
5,678,866 A 10/1997 Mina
5,686,708 A 11/1997 Spencer
5,715,182 A 2/1998 Asai et al.
5,857,563 A 1/1999 Helmer et al.

OTHER PUBLICATIONS

Appleton Electric Company, Product Catalog, Section P, pp. 2-4, effective Oct. 1993.
EGS Electrical Group/Appleton, Product Catalog, Section P, p. 19, effective Oct. 2001.
Appleton, Product Catalog, Section P, pp. 2-8, effective Sep. 2005.

* cited by examiner

*Primary Examiner*—Kyung Lee
(74) *Attorney, Agent, or Firm*—King & Spalding LLP

(57) ABSTRACT

A system and method according to which one or more sliders are actuated in order to, for example, operate one or more switches such as, for example, one or more circuit breaker switches.

39 Claims, 14 Drawing Sheets

SYSTEM AND METHOD FOR ACTUATING ONE OR MORE SLIDERS

BACKGROUND

The present disclosure relates in general to a system and method for actuating one or more sliders and in particular to a system and method for actuating one or more sliders to operate one or more switches such as, for example, one or more circuit breaker switches. The one or more sliders may be positioned in an enclosure such as, for example, a panelboard.

SUMMARY

According to one aspect of the present disclosure, a system is provided that includes a slider positioned in one of at least two positions; a device adapted to approach and engage the slider; and means for automatically adjusting the device to a position corresponding to the one of the at least two positions of the slider during the device's approach and engagement with the slider so that the slider remains in the one of the at least two positions, wherein the device is permitted to actuate the slider when the device is in the position corresponding to the one of the at least two positions of the slider.

According to another aspect of the present disclosure, a system is provided that includes a slider positioned in one of at least two positions and comprising at least one protrusion; an enclosure in which the slider is disposed; a pin adapted to approach and engage the slider; and means for automatically adjusting the pin to a position corresponding to the one of the at least two positions of the slider during the pin's approach and engagement with the slider so that the slider remains in the one of the at least two positions, comprising an angularly-extending surface defined by the protrusion and adapted to engage the pin during the pin's approach and engagement with the slider; and means for permitting the pin to rotate in response to the pin's approach and the engagement of the pin with the angularly-extending surface, comprising a shaft connected to the pin and comprising a longitudinal axis; a bearing coupled to the shaft, wherein the shaft is adapted to rotate in a first direction about its longitudinal axis in response to the pin's approach and the engagement of the pin with the angularly-extending surface; and a cover connected to the enclosure and to which the bearing is coupled wherein the pin is adapted to approach and engage the slider in response to the closing of the cover; wherein, when the cover is closed and the pin is engaged with the slider and in the position corresponding to the one of the at least two positions of the slider, the pin is adapted to rotate and actuate the slider in response to rotation of the shaft in a second direction about its longitudinal axis; and wherein, in response to the actuation of the slider, the slider is positioned in another of the at least two positions and a circuit breaker switch is operated.

According to another aspect of the present disclosure, a method is provided that includes moving a device so that the device approaches and engages a slider positioned in one of at least two positions; and automatically adjusting the device to a position corresponding to the one of the at least two positions of the slider during the device's approach and engagement with the slider so that the slider remains in the one of the at least two positions; wherein the device is permitted to actuate the slider when the device is in the position corresponding to the one of the at least two positions of the slider.

According to another aspect of the present disclosure, a method is provided that includes engaging a slider with a switch so that the slider is positioned in one of at least two positions; moving a device so that the device approaches and engages the slider positioned in the one of the at least two positions, comprising moving a cover of an enclosure in which the slider is housed, the device being coupled to the cover and comprising a pin; automatically adjusting the device to a position corresponding to the one of the at least two positions of the slider during the device's approach and engagement with the slider so that the slider remains in the one of the at least two positions, comprising engaging the pin with an angularly-extending surface of the slider, wherein the pin rotates to a position corresponding to the one of the at least two positions of the slider in response to the device's approach and the engagement of the pin with the angularly-extending surface, and wherein the device is permitted to actuate the slider when the device is in the position corresponding to the one of the at least two positions of the slider; and actuating the slider so that the slider is positioned in another of the at least two positions after automatically adjusting the device to a position corresponding to the one of the at least two positions of the slider during the device's approach and engagement with the slider, comprising rotating the pin so that the pin cammingly engages the slider; wherein a circuit breaker switch is operated in response to actuating the slider so that the slider is positioned in the another of the at least two positions.

According to another aspect of the present disclosure, a system is provided that includes first and second circuit breakers positioned in a side-by-side symmetric arrangement, each of the first and second circuit breakers comprising two or more operational modes and at least one of the first and second circuit breakers comprising a button; first and second sliders engaging the first and second circuit breakers, respectively, wherein the first and second sliders are aligned with each other; and means for permitting access to the button during each of the two or more operational modes of the at least one of the first and second circuit breakers.

According to another aspect of the present disclosure, a system is provided that includes first and second circuit breakers positioned in a side-by-side symmetric arrangement, each of the first and second circuit breakers comprising two or more operational modes and at least one of the first and second circuit breakers comprising a button; first and second sliders engaging the first and second circuit breakers, respectively, wherein the first and second sliders are aligned with each other; and means for permitting access to the button during each of the two or more operational modes of the at least one of the first and second circuit breakers, comprising a slot in at least one of the first and second sliders, the at least one of the first and second sliders engaging the at least one of the first and second circuit breakers; means for overlapping the first and second sliders so that the first and second sliders do not interfere with one another, comprising a first end portion of the first slider, the first end portion defining a first width that is less than a first maximum width defined by the first slider; and a second end portion of the second slider, the second end portion defining a second width that is less than a second maximum width defined by the second slider; wherein the first and second end portions of the first and second sliders, respectively, overlap during each of the two or more operational modes of the at least one of the first and second circuit breakers; means for guiding the first and second end portions during relative overlapping movement between the first and second end portions; means at least partially extending in the slot for activating the button, wherein the activating means at least partially extends in the slot during each of the two or more operational modes of the at least one of the first and second circuit breakers; and means for actuating each of the first and second sliders, comprising a first device adapted to approach and engage the first slider; and a second device adapted to approach and engage the second slider; wherein the first circuit breaker is in one of the two or more operational modes of the first circuit breaker during the first device's approach; wherein the second circuit breaker is in one of the two or more operational modes of the second circuit breaker during the second device's approach; wherein the system further comprises means for automatically adjusting the first device to a position corresponding to the one of the two or more operational modes of the first circuit breaker during the first device's approach and engagement with the first slider, wherein the first device is permitted to actuate the first slider when the first device is in the position corresponding to the one of the two or more operational modes of the first circuit breaker; and means for automatically adjusting the second device to a position corresponding to the one of the two or more operational modes of the second circuit breaker during the second device's approach and engagement with the second slider, wherein the second device is permitted to actuate the second slider when the second device is in the position corresponding to the one of the two or more operational modes of the second circuit breaker; and wherein the button is able to be viewed through the slot during each of the two or more operational modes of the at least one of the first and second circuit breakers.

According to another aspect of the present disclosure, a method is provided that includes positioning first and second circuit breakers in a side-by-side symmetric arrangement, each of the first and second circuit breakers comprising two or more operational modes and at least one of the first and second circuit breakers comprising a button; engaging the first and second circuit breakers with first and second sliders, respectively, wherein the first and second sliders are aligned with each other after engaging the first and second circuit breakers, respectively; and permitting access to the button during each of the two or more operational modes of the at least one of the first and second circuit breakers.

According to another aspect of the present disclosure, a method is provided that includes positioning first and second circuit breakers in a side-by-side symmetric arrangement, each of the first and second circuit breakers comprising two or more operational modes and at least one of the first and second circuit breakers comprising a button; engaging the first and second circuit breakers with first and second sliders, respectively, wherein the first and second sliders are aligned with each other; and permitting access to the button during each of the two or more operational modes of the at least one of the first and second circuit breakers, comprising providing a slot in at least one of the first and second sliders, the at least one of the first and second sliders engaging the at least one of the first and second circuit breakers; overlapping the first and second sliders so that the first and second sliders do not interfere with one another, comprising overlapping a first end portion of the first slider with a second end portion of the second slider during each of the two or more operational modes of the at least one of the first and second circuit breakers; wherein the first end portion defines a first width that is less than a first maximum width defined by the first slider; and wherein the second end portion defines a second width that is less than a second maximum width defined by the second slider; guiding the first and second end portions during relative overlapping movement between the first and second end portions; activating the button by at least partially extending a device in the slot; and actuating each of the first and second sliders, comprising moving a first device so that the first device approaches and engages the first slider; and moving a second device so that the second device approaches and engages the second slider; wherein the first circuit breaker is in one of the two or more operational modes of the first circuit breaker during the first device's approach; wherein the second circuit breaker is in one of the two or more operational modes of the second circuit breaker during the second device's approach; wherein the method further comprises automatically adjusting the first device to a position corresponding to the one of the two or more operational modes of the first circuit breaker during the first device's approach and engagement with the first slider, wherein the first device is permitted to actuate the first slider when the first device is in the position corresponding to the one of the two or more operational modes of the first circuit breaker; and automatically adjusting the second device to a position corresponding to the one of the two or more operational modes of the second circuit breaker during the second device's approach and engagement with the second slider, wherein the second device is permitted to actuate the second slider when the second device is in the position corresponding to the one of the two or more operational modes of the second circuit breaker; and wherein the button is able to be viewed through the slot during each of the two or more operational modes of the at least one of the first and second circuit breakers.

According to another aspect of the present disclosure, an apparatus is provided that includes first and second circuit breakers wherein the second circuit breaker is positioned directly beneath the first circuit breaker; first and second sliders engaged with the first and second circuit breakers, respectively; and first and second operators for actuating the first and second sliders, respectively, wherein the second operator is aligned with and positioned directly beneath the first operator so that the relative positions of the first and second operators correspond to the relative positions of the first and second circuit breakers.

According to another aspect of the present disclosure, an apparatus is provided that includes first and second circuit breakers wherein the second circuit breaker is positioned directly beneath the first circuit breaker; first and second sliders engaged with the first and second circuit breakers, respectively; and first and second operators for actuating the first and second sliders, respectively, wherein the second operator is aligned with and positioned directly beneath the first operator so that the relative positions of the first and second operators correspond to the relative positions of the first and second circuit breakers; wherein each of the first and second operators comprises a handle, each handle comprising an angularly-extending portion so that the handle of the second operator is in a nesting arrangement with the handle of the first operator; wherein each handle is adapted to rotate to actuate the respective first or second slider and wherein the nesting arrangement permits the second handle to rotate, relative to the first handle, over at least a predetermined range of rotation; wherein each of the first and second circuit breakers comprises a switch engaged with the respective first or second slider so that the switch is operated in response to the actuation of the respective first or second slider; wherein each of the first and second operators comprises a shaft comprising a longitudinal center axis and wherein the longitudinal center axis of the shaft of the second operator extends between the first and second circuit breakers; wherein a spacing is defined between the centerline of the switch of the second circuit breaker and the longitudinal axis of the shaft of the second operator; wherein each of the first and second circuit breakers defines a width; and wherein the spacing is substantially equal to about half of the width of the second circuit breaker to accommodate a compact arrangement between the first and second circuit breakers.

According to another aspect of the present disclosure, an apparatus for approaching and actuating a slider engaged with a device is provided that includes a shaft comprising a longitudinal center axis about which the shaft is adapted to rotate in place; and a pin connected to the shaft, wherein the pin is adapted to rotate and engage the slider in response to the rotation of the shaft; wherein the slider translates in response to the engagement between the pin and the slider.

According to another aspect of the present disclosure, an apparatus for approaching and actuating a slider engaged with a circuit breaker is provided that includes a shaft comprising an external threaded connection and a longitudinal center axis about which the shaft is adapted to rotate in place; and a pin connected to the shaft and adapted to rotate in response to the rotation of the shaft, the pin comprising a base defining a diameter of about 0.352 inches, a cam lobe extending from the base and defining a radius of about 0.750 inches, wherein the cam lobe cammingly engages the slider in response to the rotation of the shaft and the slider translates in response to the camming engagement between the cam lobe and the slider, and a planar surface adapted to be positioned proximate the slider during the camming engagement between the cam lobe and the slider; a handle connected to the shaft and aligned with the pin, the handle comprising an angularly-extending portion that is adapted to be placed in a nesting arrangement with at least one other handle, wherein the nesting arrangement between the handle and the at least one other handle permits the handle to rotate over at least a predetermined range of rotation; and a bearing through which the shaft extends, the bearing comprising an internal threaded connection threadably engaged with the external threaded connection of the shaft; wherein a switch of the circuit breaker is operated in response to the translation of the slider, the switch comprising a centerline that extends in the direction of translation of the slider, wherein a predetermined distance of about 0.5 inches is defined between the longitudinal center axis of the shaft and the centerline of the switch; and wherein the predetermined range of rotation comprises a range of rotation in a first direction to place the switch in at least one position, and a range of rotation in a second direction opposing the first direction to place the switch in at least one other position.

According to another aspect of the present disclosure, an apparatus for approaching and actuating a slider engaged with a circuit breaker is provided that includes a shaft comprising an external threaded connection and a longitudinal center axis about which the shaft is adapted to rotate in place; and a pin connected to the shaft and adapted to rotate in response to the rotation of the shaft, the pin comprising a generally cylindrical first portion extending from the shaft in a first direction, the first portion defining a first diameter of about 0.25 inches; and a generally cylindrical second portion extending from the first portion in a second direction, the second portion defining a second diameter that is substantially equal to the first diameter; wherein the second portion cammingly engages the slider in response to the rotation of the shaft and the slider translates in response to the camming engagement between the second portion and the slider; and wherein an angle of about 150 degrees is defined between the first and second directions; a handle connected to the shaft, the handle comprising an angularly-extending portion that is adapted to be placed in a nesting arrangement with at least one other handle, wherein the nesting arrangement between the handle and the at least one other handle permits the handle to rotate over at least a predetermined range of rotation; a bearing through which the shaft extends, the bearing comprising an internal threaded connection threadably engaged with the external threaded connection of the shaft; wherein a switch of the circuit breaker is operated in response to the translation of the slider, the switch comprising a centerline that extends in the direction of translation of the slider, wherein a predetermined distance of about 1.5 inches is defined between the longitudinal center axis of the shaft and the centerline of the switch; and wherein the predetermined range of rotation comprises a range of rotation in a first direction to place the switch in at least one position, and a range of rotation in a second direction opposing the first direction to place the switch in at least one other position.

DETAILED DESCRIPTION OF THE ILLUSTRATIVE EMBODIMENTS

Figure 1:
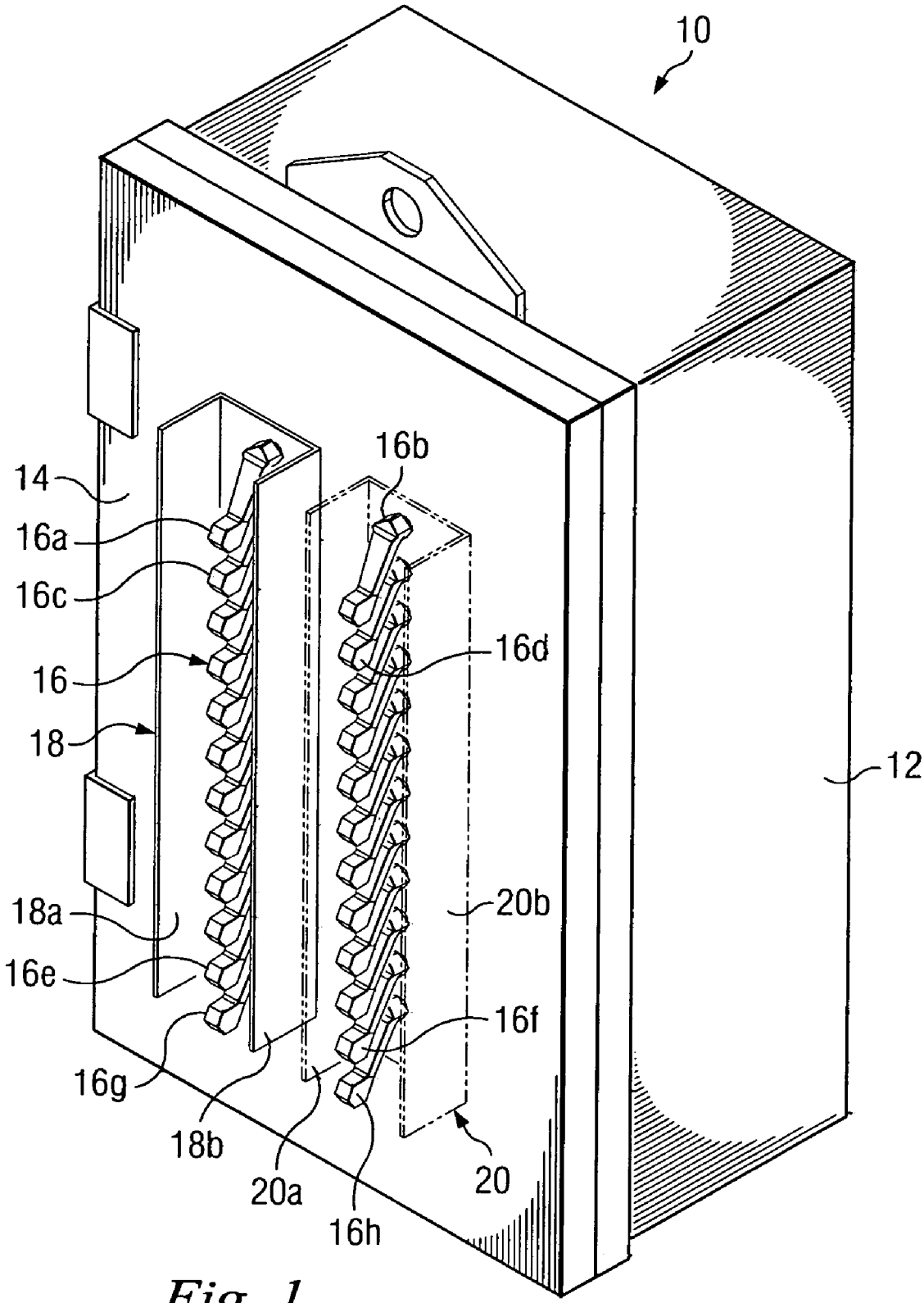
FIG. 1 is a perspective view of a panelboard including a cover that is closed and a plurality of operators according to an embodiment.

In an exemplary embodiment, as illustrated in FIG. 1, an enclosure such as, for example, a panelboard is generally referred to by the reference numeral 10 and includes an enclosure body 12 and a cover 14 hingedly connected thereto. In an exemplary embodiment, the panelboard 10 may be explosion proof and/or may be used in a wide variety of different applications and/or environments such as, for example, branch power distribution and/or circuit protection in areas made hazardous by, for example, the presence of flammable gases, vapors, and/or combustible dusts, and/or the presence of dampness and/or corrosion. In an exemplary embodiment, the cover 14 may be closed and secured to the enclosure body 12 by, for example, a plurality of captive hex-head bolts.

A plurality of devices such as, for example, a plurality of operators 16 extend through and are coupled to the cover 14, and include operators 16*a*, 16*b*, 16*c*, 16*d*, 16*e*, 16*f*, 16*g* and 16*h*. The operators 16*a*, 16*c*, 16*e* and 16*g* are all aligned with each other, and the operators 16*b*, 16*d*, 16*f* and 16*h* are all aligned with each other. The operators 16*c* and 16*d* are positioned directly beneath the operators 16*a* and 16*b*, respectively, and the operators 16*g* and 16*h* are positioned directly beneath the operators 16*e* and 16*f*, respectively. The operators 16 will be described in further detail below.

A lockout plate 18 is connected to the cover 14 and includes walls 18*a* and 18*b* that extend away from the cover and partially enclose a portion of the plurality of operators 16, including the operators 16*a*, 16*c*, 16*e* and 16*g*. Similarly, a lockout plate 20 is connected to the cover 14 and includes walls 20*a* and 20*b* that extend away from the cover and partially enclose another portion of the plurality of operators 16, including the operators 16*b*, 16*d*, 16*f* and 16*h*.

Figure 2:
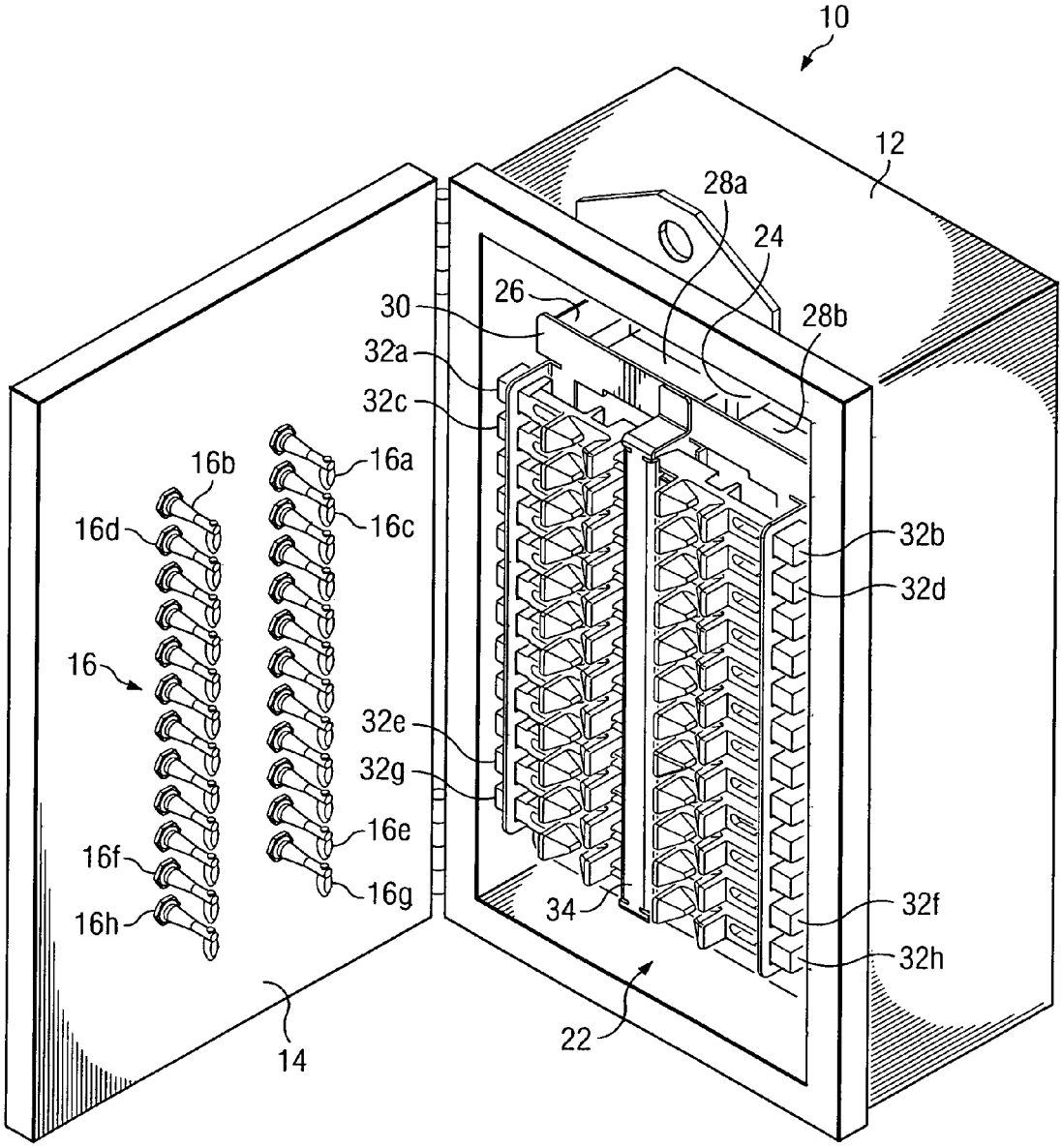
FIG. 2 is a perspective view of the panelboard of FIG. 1 but depicting the cover open and components according to an embodiment positioned in the panelboard.

In an exemplary embodiment, as illustrated in FIG. 2, the enclosure body 12 defines a chamber 22 in which a mounting plate 24 is positioned. A chassis 26 is coupled to the mounting plate 22 and a plurality of circuit breakers 28 are mounted to the chassis, including circuit breakers 28*a* and 28*b*. In an exemplary embodiment, the plurality of circuit breakers 28 may be divided into at least two columns of circuit breakers 28 so that the columns define a plurality of pairs of circuit breakers 28 positioned in an operational side-by-side symmetric arrangement, including symmetric circuit breakers 28*a* and 28*b*.

A plate member 30 is connected to the chassis 26 and a plurality of sliders 32 are slidably engaged with the plate member, including pairs of vertically-aligned sliders 32*a* and 32*b*, 32*c* and 32*d*, 32*e* and 32*f*, and 32*g* and 32*h*. A strip 34 is connected to the plate member 30, the strip and the plate member retaining the sliders 32 in a manner to be described in further detail below. In an exemplary embodiment, the quantity of circuit breakers 28 may be equal to the quantity of sliders 32 which, in turn, may be equal to the quantity of operators 16.

Figure 3:
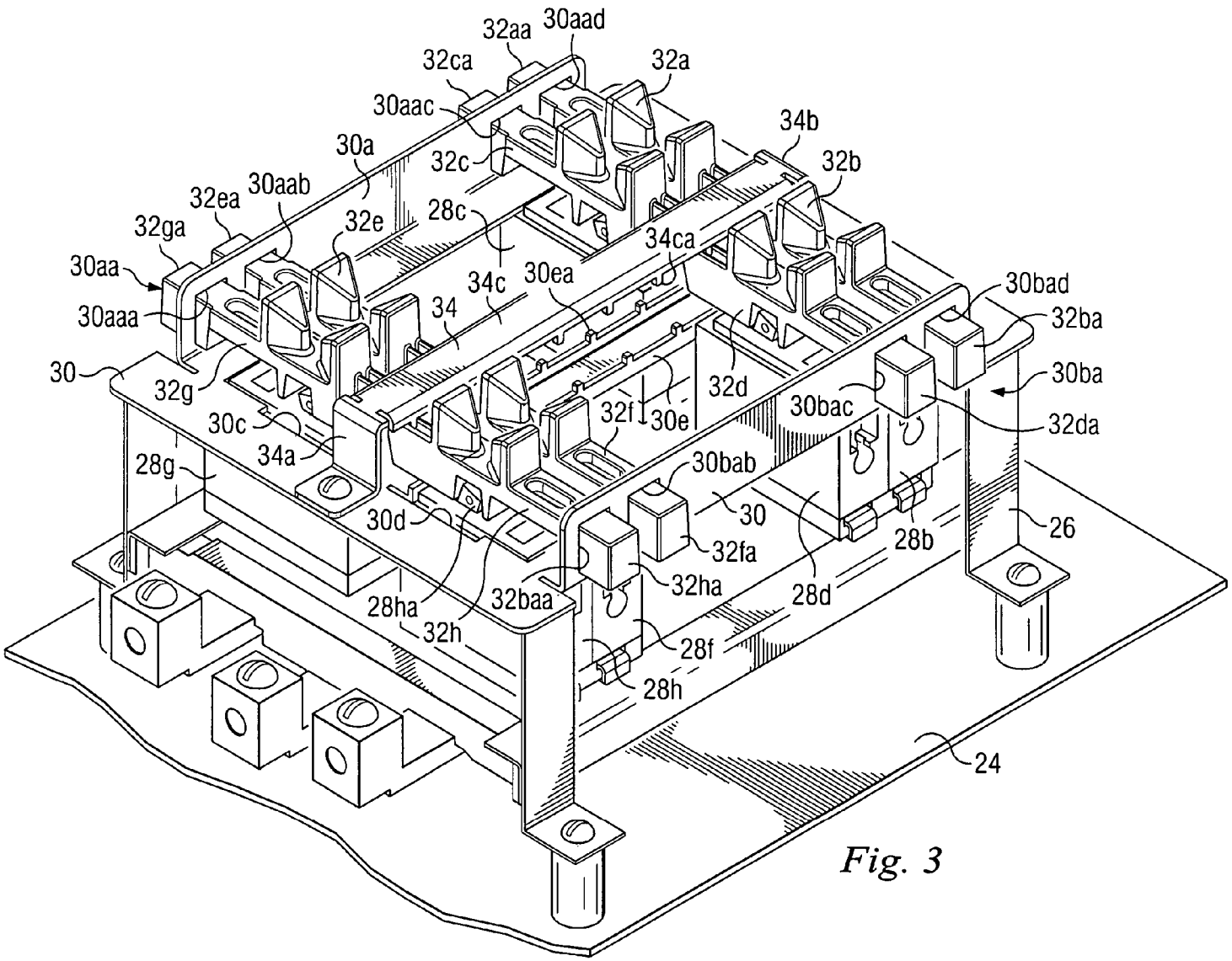
FIG. 3 is an enlarged perspective view of a portion of the components of FIG. 2.
Figure 13A:
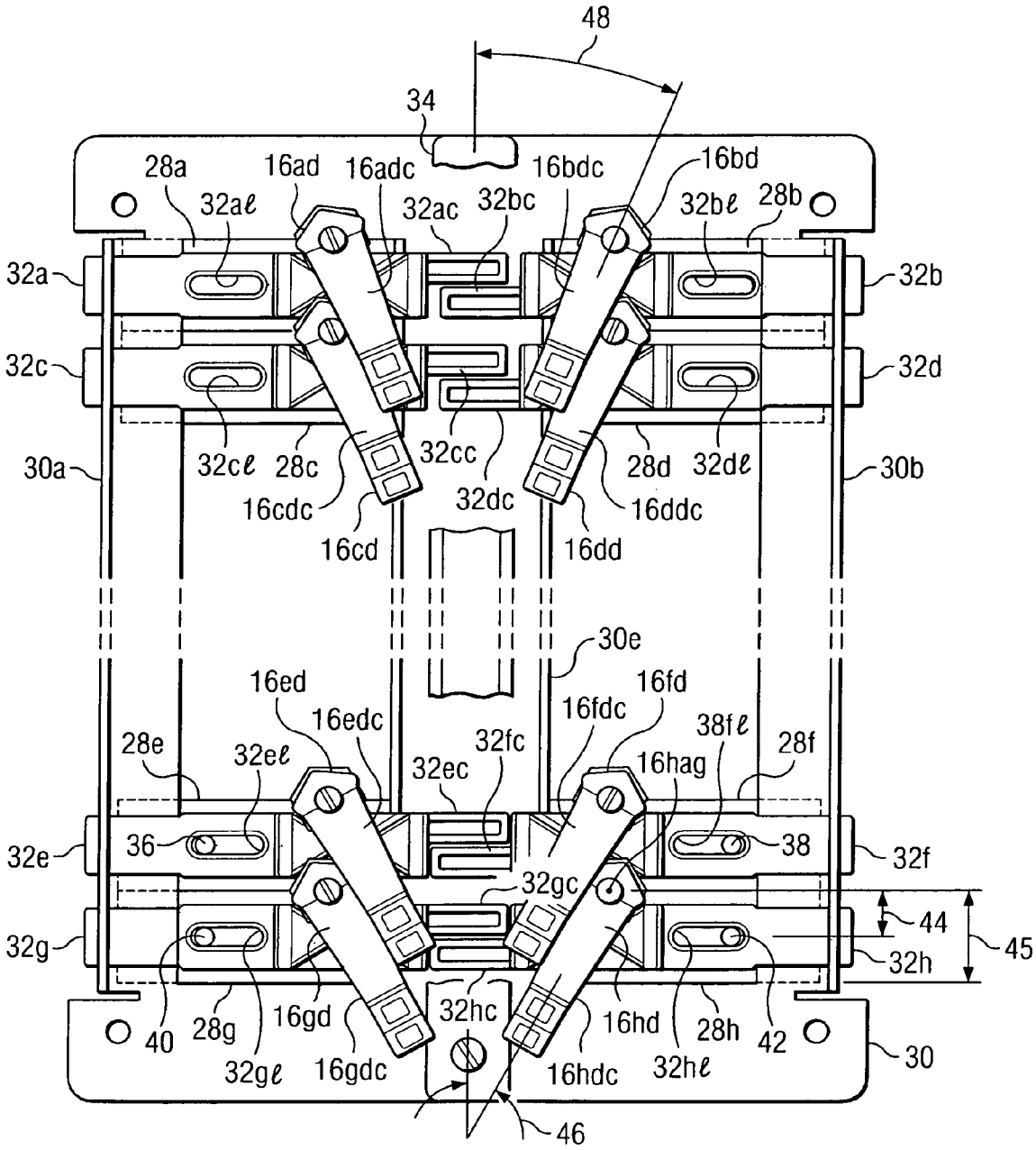
FIG. 13A is an elevational view of a portion of the components of FIG. 2 in an operational position.
Figure 14B:
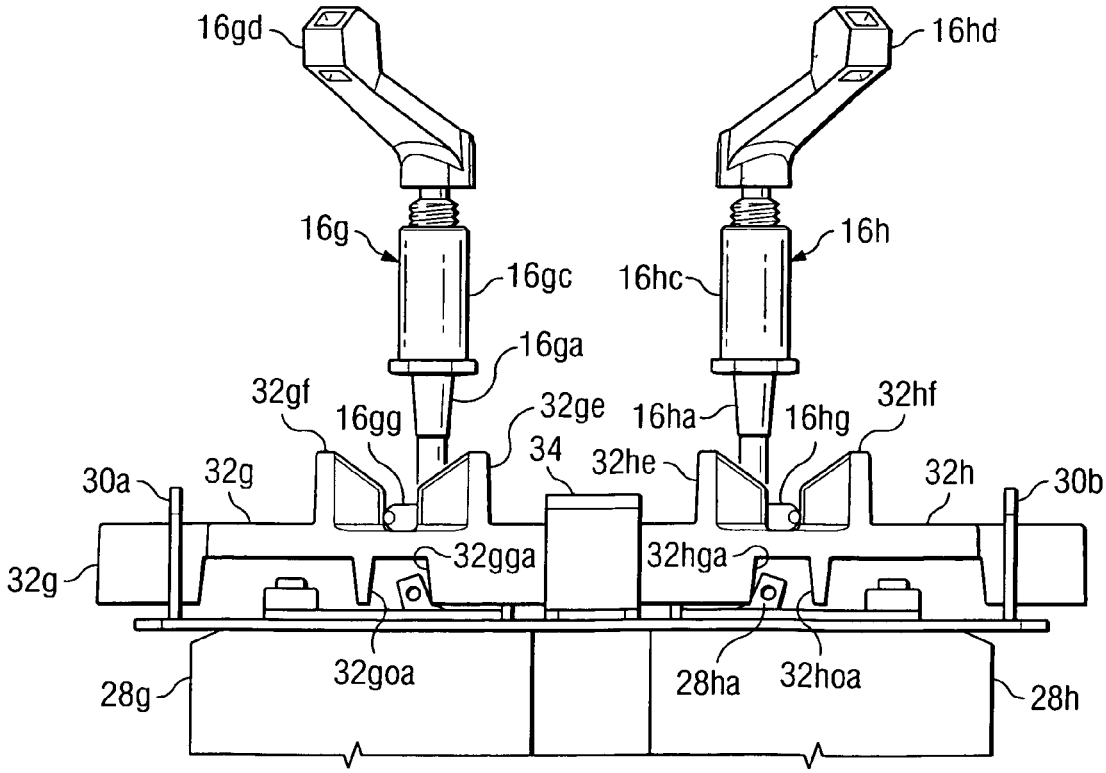
FIG. 14B is a plan view of the portion of the components depicted in FIG. 14A.
Figure 14A:
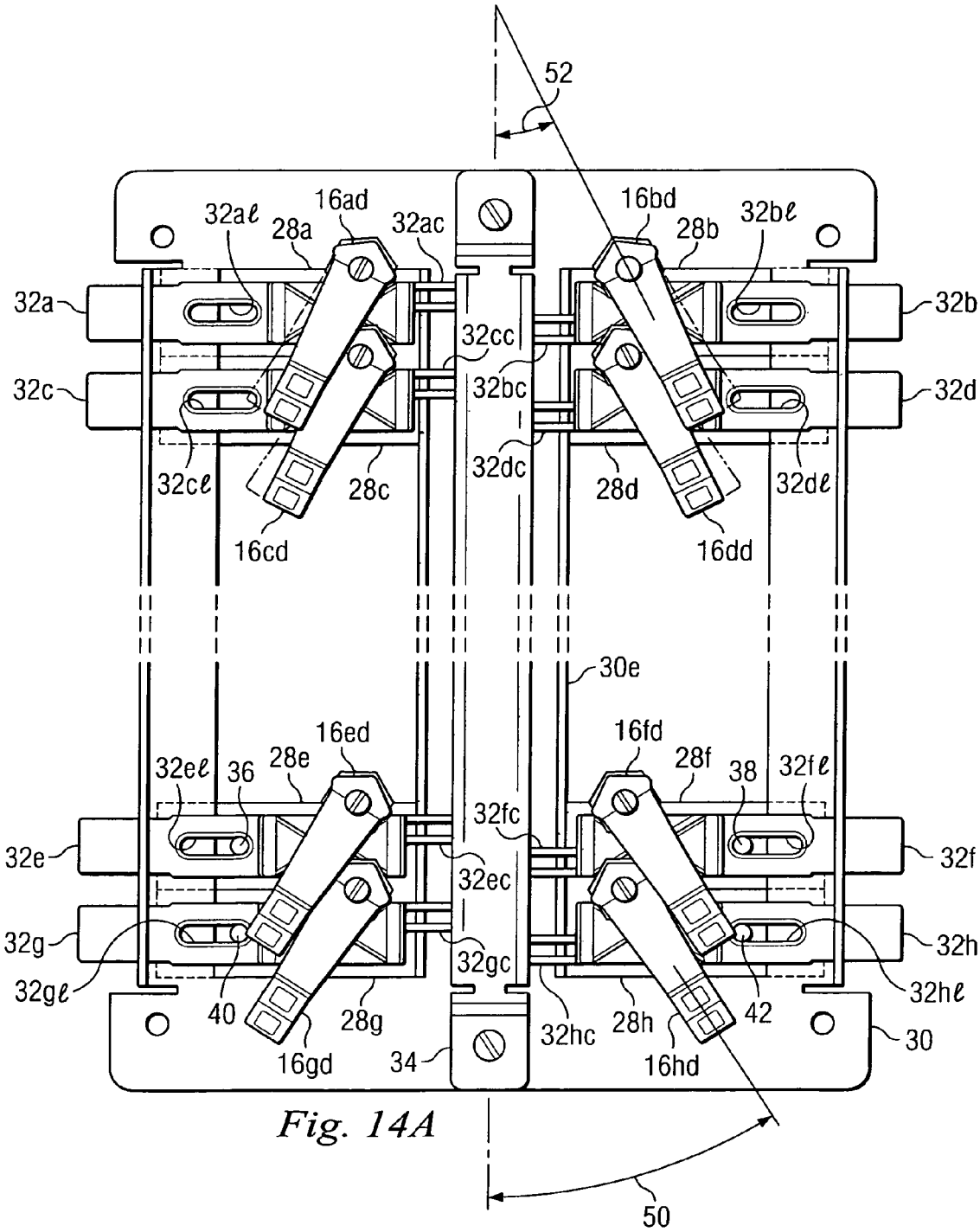
FIG. 14A is a view similar to that of FIG. 13A but depicting another operational position for some of the components.

In an exemplary embodiment, as illustrated in FIG. 3, the plurality of circuit breakers 28 further includes circuit breakers 28*c*, 28*d*, 28*f*, 28*g* and 28*h*, and a circuit breaker 28*e* that is behind the slider 32*e* and hidden from view (see FIGS. 13A and 14A). In an exemplary embodiment, in addition to the pair of circuit breakers 28*a* and 28*b*, the pairs of circuit breakers 28*c* and 28*d*, 28*e* and 28*f*, and 28*g* and 28*h*, are each positioned in an operational side-by-side symmetric arrangement. As shown in FIG. 3, with reference to FIG. 2, the circuit breakers 28*c* and 28*d* are positioned directly beneath the circuit breakers 28*a* and 28*b*, respectively, and the circuit breakers 28*g* and 28*h* are positioned directly beneath the circuit breakers 28*e* and 28*f*, respectively. The relative positions of the operators 16*a*, 16*c*, 16*e* and 16*g* correspond to the relative positions of the circuit breakers 28*a*, 28*c*, 28*e* and 28*g*, respectively, and the relative positions of the operators 16*b*, 16*d*, 16*f* and 16*h* correspond to the relative positions of the circuit breakers 28*b*, 28*d*, 28*f* and 28*h*, respectively. The remainder of the circuit breakers 28 and/or the sliders 32 that are depicted in FIG. 2 are removed from FIG. 3 for the purpose of clarity.

The plate member 30 includes a pair of walls 30*a* and 30*b*, and a plurality of openings 30*baa* is formed in the wall 30*a*, including openings 30*aaa*, 30*aab*, 30*aac* and 30*aad*. End portions 32*aa*, 32*ca*, 32*ea* and 32*ga* of the sliders 32*a*, 32*c*, 32*e* and 32*g*, respectively, extend through the openings 30*aad*, 30*aac*, 30*aab* and 30*aaa*, respectively. Similarly, a plurality of openings 30*ba* is formed in the wall 30*b*, including openings 30*baa*, 30*bab*, 30*bac* and 30*bad*. End portions 32*ba*, 32*da*, 32*fa* and 32*ha* of the sliders 32*b*, 32*d*, 32*f* and 32*h*, respectively, extend through the openings 30*bad*, 30*bac*, 30*bab* and 30*baa*, respectively. A through-opening 30*c* is formed in the plate member 30, and the sliders 32*a*, 32*c*, 32*e* and 32*g* extend across the through-opening. Similarly, a through-opening 30*d* is formed in the plate member 30, and the sliders 32*b*, 32*d*, 32*f* and 32*h* extend across the through-opening. A U-shaped center bar 30*e* separates the through-openings 30*c* and 30*d*, and includes a plurality of projections 30*ea*.

The strip 34 includes a pair of opposing and symmetric L-shaped tabs 34*a* and 34*b*, via which the strip is connected to the plate member 30. A U-shaped middle portion 34*c* extends between the tabs and includes a plurality of projections 34*ca* that extend towards the center bar 30*e* of the plate member 30.

Figure 4:
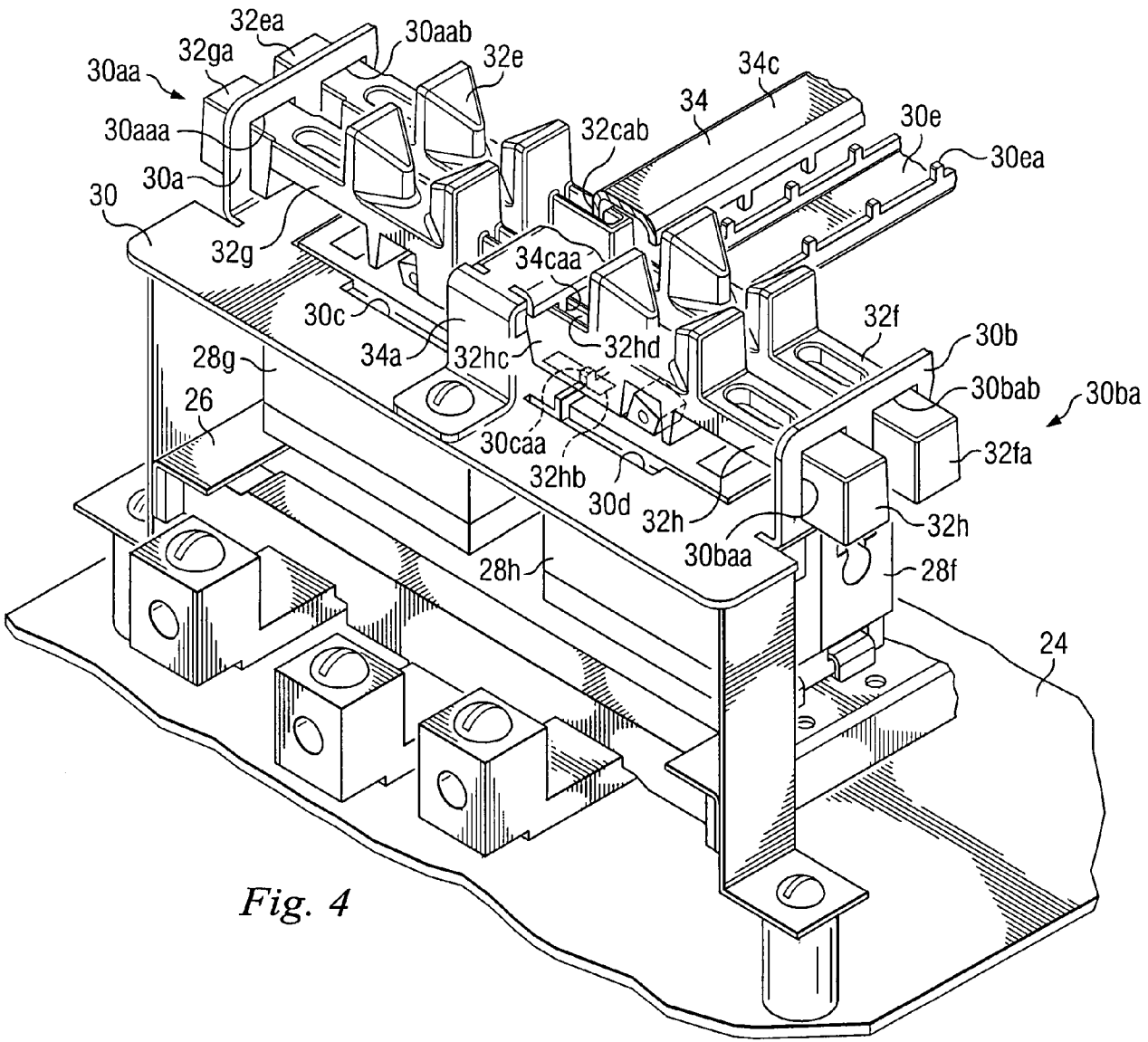
FIG. 4 is a view similar to that of FIG. 3 but depicting an enlarged partial perspective/partial sectional portion thereof.
Figure 5:
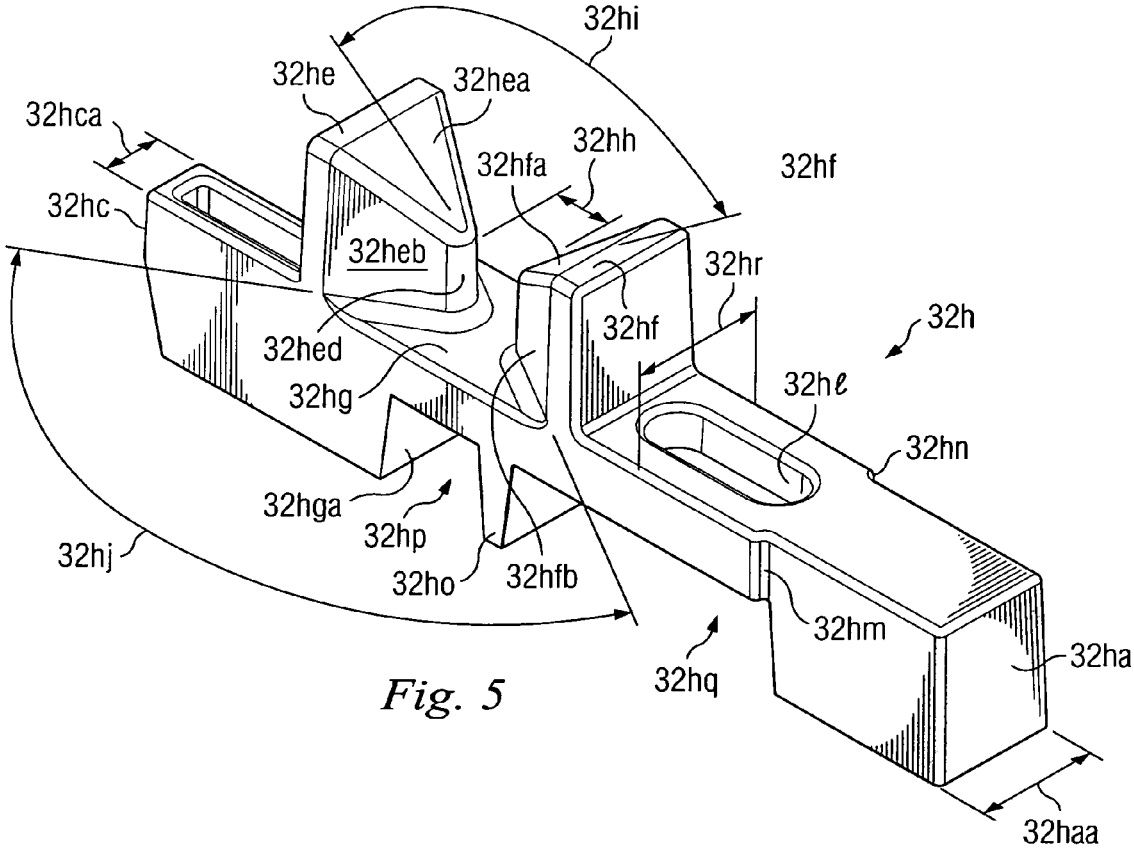
FIG. 5 is a perspective view of a slider according to an embodiment.
Figure 6:
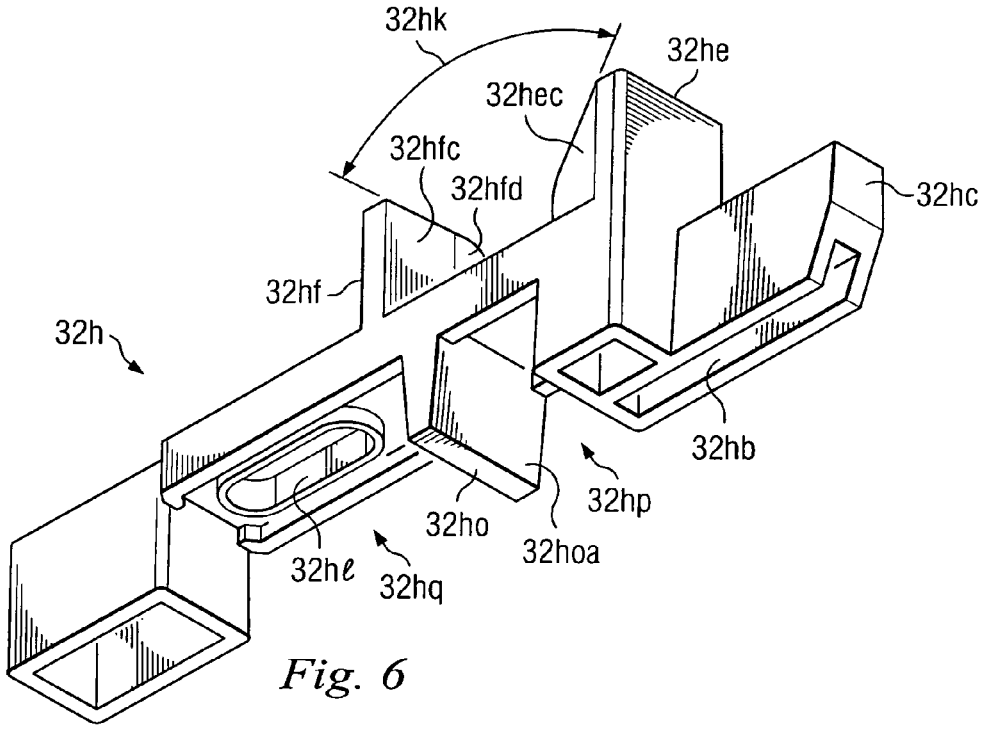
FIG. 6 is another perspective view of the slider of FIG. 5.
Figure 7:
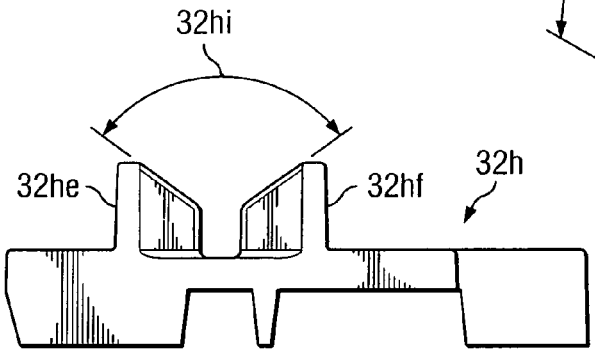
FIG. 7 is an elevational view of the slider of FIG. 5.
Figure 8:
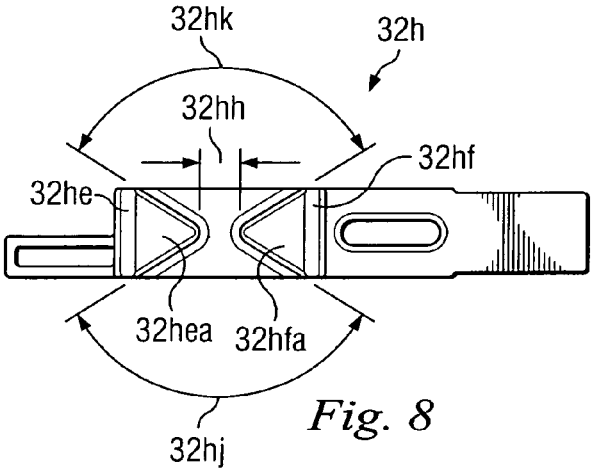
FIG. 8 is a plan view of the slider of FIG. 5.
Figure 10:
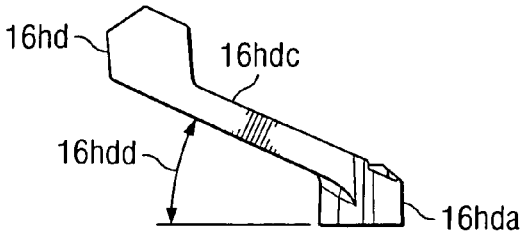
FIG. 10 is an elevational view of a handle of the operator of FIG. 9.

In an exemplary embodiment, as illustrated in FIG. 4, a projection 30*eaa* in the plurality of projections 30*ea* engages the slider 32*h*, extending into a channel 32*hb* formed in an end portion 32*hc* of the slider 32*h* that extends between the plate member 30 and the strip 34. Although not shown in FIG. 4, other projections in the plurality of projections 30*ea* engage the sliders 32*a*, 32*b*, 32*c*, 32*d*, 32*e*, 32*f* and 32*g*, respectively, in a manner substantially similar to the manner in which the projection 30*eaa* engages the slider 32*h*.

A projection 34*caa* in the plurality of projections 34*ca* engages the slider 32*h*, extending into a channel 32*hd* formed in the end portion 32*hc* of the slider 32*h*. A projection 34*cab* engages the slider 32*e* in a manner substantially similar to the manner in which the projection 34*caa* engages the slider 32*h*. Although not shown in FIG. 4, other projections in the plurality of projections 34*ca* engage the sliders 32*a*, 32*b*, 32*c*, 32*d*, 32*f* and 32*g*, respectively, in a manner substantially similar to the manner in which the projection 34*caa* engages the slider 32*h*.

In an exemplary embodiment, the plate member 30 and the strip 34 retain the sliders 32*a*, 32*c*, 32*e* and 32*g* via the extension of the end portions 32*aa*, 32*ca*, 32*ea* and 32*ga* of the sliders 32*a*, 32*c*, 32*e* and 32*g*, respectively, through the openings 30*aad*, 30*aac*, 30*aab* and 30*aaa*, respectively, and via the engagement of the projections in the plurality of projections 34*ca* with the respective sliders 32*a*, 32*c*, 32*e* and 32*g*, while permitting the sliders 32*a*, 32*c*, 32*e* and 32*g* to slide, relative to the plate member 30 and the strip 34, towards or away from the center bar 30*e*. Similarly, the plate member 30 and the strip 34 retain the sliders 32*b*, 32*d*, 32*f* and 32*h* via the extension of the end portions 32*ba*, 32*da*, 32*fa* and 32*ha* of the sliders 32*b*, 32*d*, 32*f* and 32*h*, respectively, through the openings 30*bad*, 30*bac*, 30*bab* and 30*baa*, respectively, and via the engagement of the projections in the plurality of projections 34*ca* with the respective sliders 32*b*, 32*d*, 32*f* and 32*h*, while permitting the sliders 32*b*, 32*d*, 32*f* and 32*h* to slide, relative to the plate member 30 and the strip 34, towards or away from the center bar 30*e*.

At least a portion of the circuit breaker 28*h* extends through the through-opening 30*d* to permit the slider 32*h* to engage and operate a switch 28*ha* of the circuit breaker 28*h* to operate the circuit breaker in a manner to be described in detail below. In an exemplary embodiment, at least portions of the circuit breakers 28*b*, 28*d* and 28*f* also extend through the through-opening 30*d* in a manner similar to the manner in which the at least a portion of the circuit breaker 28*h* extends through the through-opening. In an exemplary embodiment, at least portions of the circuit breakers 28*a*, 28*c*, 28*e* and 28*g* extend through the through-opening 30*c* in a manner similar to the manner in which the at least a portion of the circuit breaker 28*h* extends through the through-opening 30*d*.

In an exemplary embodiment, as illustrated in FIGS. 5, 6, 7 and 8, protrusions 32*he* and 32*hf* extend from a middle portion 32*hg* of the slider 32*h*. An angularly-extending or ramp surface 32*hea* and side surfaces 32*heb* and 32*hec* are defined by the protrusion 32*he*, and an angularly-extending or ramp surface 32*hfa* and side surfaces 32*hfb* and 32*hfc* are defined by the protrusion 32*hf*. The surfaces 32*hea* and 32*hfa* are substantially triangle shaped.

A curved surface 32*hed* extends between the side surfaces 32*heb* and 32*hec*, and a curved surface 32*hfd* extends between the side surfaces 32*hfb* and 32*hfc*. A spacing 32*hh* is defined between the peaks of the curved surfaces 32*hed* and 32*hfd*. In an exemplary embodiment, the spacing 32*hh* may range from about 0.275 inches to about 0.350 inches. In an exemplary embodiment, the spacing 32*hh* may be about 0.314 inches.

An angle 32*hi* is defined between the ramp surfaces 32*hea* and 32*hfa*. In an exemplary embodiment, the angle 32*hi* may be about 107.1 degrees. An angle 32*hj* is defined between the surfaces 32*heb* and 32*hfb*, and an angle 32*hk* is defined between the surfaces 32*hec* and 32*hfc*. In an exemplary embodiment, the angle 32*hj* may be about 120.4 degrees. In an exemplary embodiment, the angle 32*hk* may be substantially equal to the angle 32*hj*. In an exemplary embodiment, the angles 32*hj* and 32*hk* may each be about 120.4 degrees.

A slot 32*hl* is formed through the middle portion 32*hg*, and shoulders 32*hm* and 32*hn* are formed at the transition between the middle portion and the end portion 32*ha*. A contact surface 32*hga* is defined by the middle portion 32*hg*, and a projection 32*ho* extends from the middle portion in a direction opposite that of the protrusions 32*he* and 32*hf*. A contact surface 32*hoa* is defined by the projection 32*ho*, and a region 32*hp* is defined between the contact surfaces 32*hga* and 32*hoa*. A region 32*hq* is defined between the end portion 32*ha* and the projection 32*ho*. The end portions 32*ha* and 32*hc* may define widths 32*haa* and 32*hca*, respectively, and a maximum width 32*hr* of the slider 32*h* may be defined by the middle portion 32*hg*. The width 32*hca* is less than the width 32*haa* which, in turn, is less than the width 32*hr*. In an exemplary embodiment, the width 32*haa* may be equal to the width 32*hr*. In an exemplary embodiment, the width 32*hca* may be substantially half of the width 32*haa*.

In several exemplary embodiments, the slider 32*h* may be composed of a wide variety of materials. In an exemplary embodiment, the slider 32*h* may be composed of any material that promotes a substantially smooth sliding engagement with another material such as, for example, any type of metal, without the need for lubrication. In an exemplary embodiment, the slider 32*h* may be composed of a material that has an inherent lubricity to promote a substantially smooth sliding engagement such as, for example, Celcon GC25A, or a material that is equivalent to Celcon GC25A. In an exemplary embodiment, the slider 32*h* may be composed of acetal, which has an inherent lubricity to promote a substantially smooth sliding engagement.

In several exemplary embodiments, the remainder of the sliders 32 in the plurality of sliders 32, including the sliders 32*a*, 32*b*, 32*c*, 32*d*, 32*e*, 32*f* and 32*g*, are substantially similar to the slider 32*h* and therefore will not be described in detail. In the description below, any reference numerals used to refer to features of the sliders 32*a*, 32*b*, 32*c*, 32*d*, 32*f* and 32*g* will correspond to the reference numerals for the features of the slider 32*h*, except that the first letter position for the reference numerals used to describe the slider 32*h*, that is, h, will be replaced by the first letter position of the particular replacement slider, that is, a, b, c, d, e, f or g for the sliders 32*a*, 32*b*, 32*c*, 32*d*, 32*e*, 32*f* or 32*g*, respectively.

In an exemplary embodiment, as illustrated in FIGS. 9, 10,11 and 12, the operator 16*h* includes a shaft 16*ha* including a proximal end portion 16*haa*, an external threaded connection 16*hab*, a tapered portion 16*hac* and a distal end portion 16*had*, through which a through-hole 16*hae* extends. The exterior of the proximal end portion 16*haa* is substantially square-shaped, and an internal threaded connection 16*haf* extends into the proximal end portion. The shaft 16*ha* further includes a longitudinal center axis 16*hag* and an external annular recess 16*hah* positioned between the external threaded connection 16*hab* and the tapered portion 16*hac*.

An o-ring 16*hb* is disposed in the external annular recess 16*hah*. A bearing 16*hc* including an internal threaded connection 16*hca* is coupled to the shaft 16*ha* so that the shaft extends through the bearing, with the external threaded connection 16*hab* being threadably engaged with the internal threaded connection 16*hca*. As a result, a portion of the external threaded connection 16*hab* extends outside of the bearing 16*hc* and the o-ring 16*hb* forms a sealing engagement between the bearing 16*hc* and the external annular recess 16*hah*. In an exemplary embodiment, the external threaded connection 16*hab* may be threadably engaged with the internal threaded connection 16*hca* until the shaft 16*ha* is in a fully-seated position in the bearing 16*hc*, and then the external threaded connection 16*hab* is backed out from the fully-seated position in the bearing by a predetermined number of turns. In an exemplary embodiment, the predetermined number of turns may range from about 1 turn to about 4 turns. In an exemplary embodiment, the bearing 16*hc* extends through the cover 14 and is coupled to the cover in a conventional manner.

A handle 16*hd* includes a proximal end portion 16*hda* and an opening 16*hdb* formed through the proximal end portion, the opening including a square-shaped through-portion 16*hdba* and a countersunk portion 16*hdbb*. An angularly-extending portion 16*hdc* extends from the proximal end portion 16*hda* and defines an angle 16*hdd* between the angularly-extending portion and an imaginary plane that is perpendicular to the longitudinal center axis 16*hag* of the shaft 16*ha*. In an exemplary embodiment, the angle 16*hdd* may be about 25.0 degrees.

The proximal end portion 16*hda* of the handle 16*hd* fits over the square-shaped proximal end portion 16*haa* of the shaft 16*ha* so that the square-shaped proximal end portion 16*haa* extends into the square-shaped through-portion 16*hdba* of the opening 16*hdb*. A washer 16*he* is received within the countersunk portion 16*hdbb* of the opening 16*hdb* and a fastener such as, for example, a screw 16*hf* extends through the opening 16*hdb* and is threadably engaged with the internal threaded connection 16*haf* of the proximal end portion 16*haa* of the shaft 16*ha*, thereby connecting the handle 16*hd* to the shaft 16*ha*.

A device such as a pin 16*hg* includes a stem 16*hga* that extends through the bore 16*hae* to connect the pin to the shaft 16*ha*. A cam lobe 16*hgb* extends from a base 16*hgc*, and a transition portion 16*hgd* extends from the base in a direction opposite that of the cam lobe 16*hgb*. The pin 16*hg* further includes planar surfaces 16*hge* and 16*hgf* spaced in a parallel relation. In an exemplary embodiment, the planar surfaces 16*hge* and 16*hgf* may be formed by removing material from the cam lobe 16*hgb*, the base 16*hgc* and/or the transition portion 16*hgd*.

Figure 9:
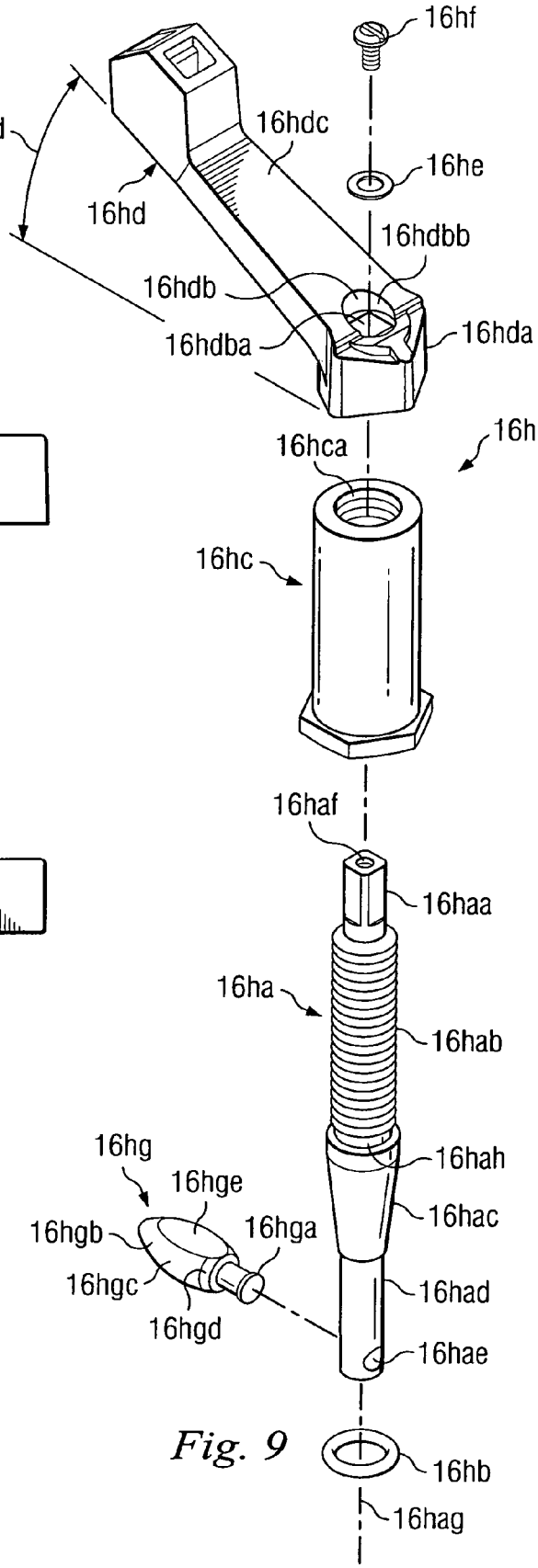
FIG. 9 is an exploded view of one of the operators of FIG. 1.

In an exemplary embodiment, as shown in FIG. 9, the pin 16*hg* extends from the shaft 16*ha* so that the pin and the handle 16*hd* are aligned, that is, both the pin 16*hg* and the handle 16*hd* extend in the same direction from the center axis 16*hag* of the shaft 16*ha*. In an exemplary embodiment, the pin 16*hg* and the handle 16*hd* may be un-aligned, that is the pin and the handle may extend in different directions from the center axis 16*hag* of the shaft 16*ha*. For example, the pin 16*hg* and the handle 16*hd* may extend from the center axis 16*hag* of the shaft 16*ha* in directions that are 180 degrees apart, that is, the pin and the handle may extend in opposing directions.

Figure 11:
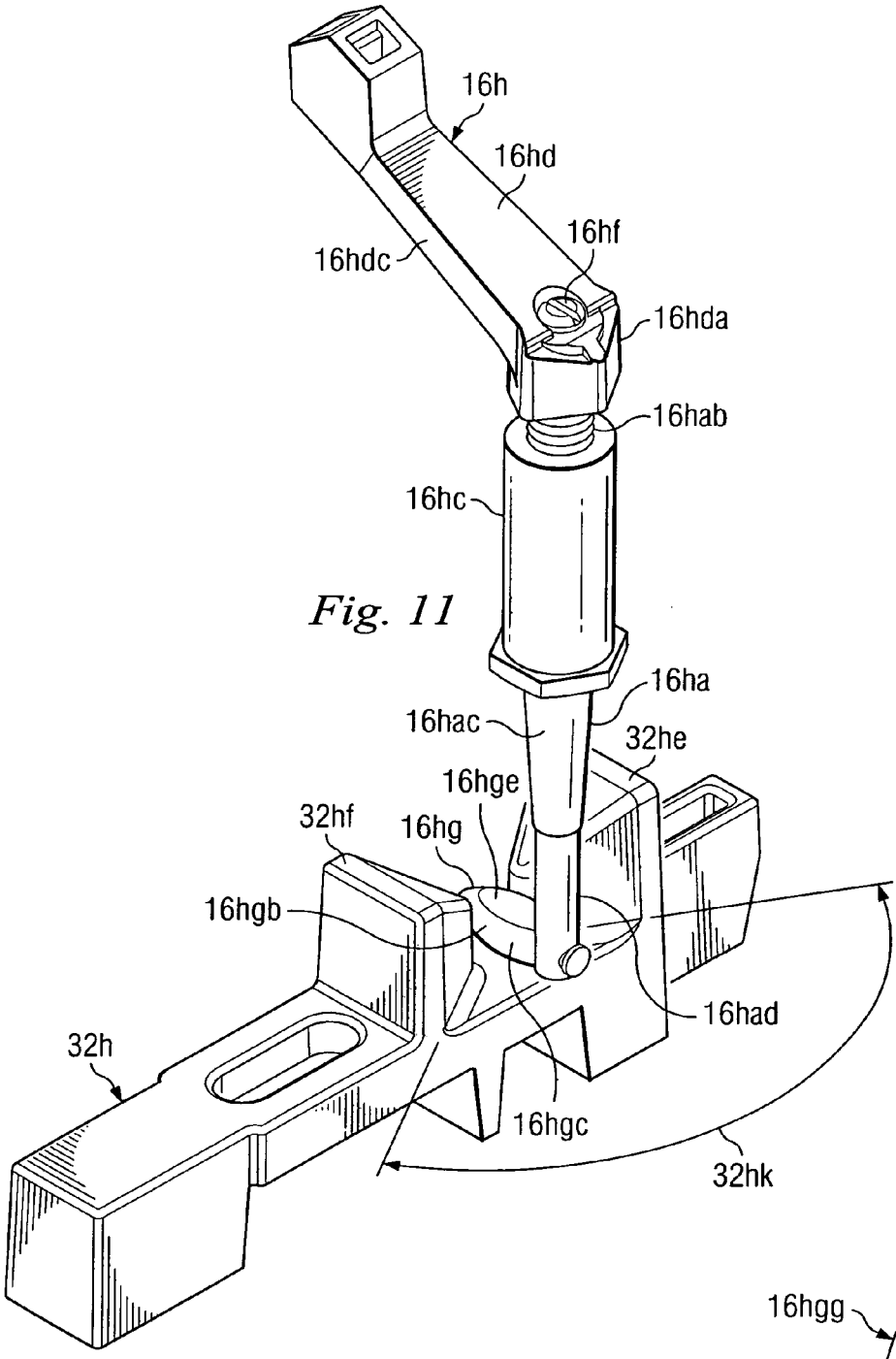
FIG. 11 is an unexploded view of the operator of FIG. 9 and the slider of FIGS. 5-8.

In an exemplary embodiment, as shown in FIG. 11, the operator 16*h* is aligned with the slider 32*h*, when the cover 14 is closed and secured to the enclosure body 12, so that the pin 16*hg* is permitted to extend between the protrusions 32*he* and 32*hf* of the slider 32*h* under conditions to be described, with the pin at least partially extending within the spacing 32*hh*, and at least partially extending within a region defined by the angle 32*hk*.

Figure 12:
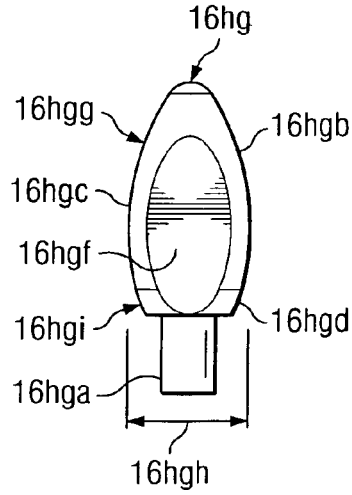
FIG. 12 is an elevational view of a portion of the operator of FIG. 9.

In an exemplary embodiment, as shown in FIG. 12, the cam lobe 16*hgb* defines a radius 16*hgg*, the base 16*hgc* defines a diameter 16*hgh*, and the transition portion 16*hgd* defines a radius 16*hgi*. In an exemplary embodiment, the radius 16*hgg* may range from about 0.5 inches to about 1 inch. In an exemplary embodiment, the radius 16*hgg* may be about 0.750 inches. In an exemplary embodiment, the diameter 16*hgh* may range from about 0.2 inches to about 0.5 inches. In an exemplary embodiment, the diameter 16*hgh* may be about 0.352 inches. In an exemplary embodiment, the radius 16*hgi* may be about 0.313 inches.

In several exemplary embodiments, the remainder of the operators 16 in the plurality of operators 16, including the operators 16*a*, 16*b*, 16*c*, 16*d*, 16*e*, 16*f* and 16*g*, are substantially similar to the operator 16*h* and therefore will not be described in detail. In the description below, any reference numerals used to refer to features of the operators 16*a*, 16*b*, 16*c*, 16*d*, 16*f* and 16*g* will correspond to the reference numerals for the features of the operator 16*h*, except that the first letter position for the reference numerals used to describe the operator 16*h*, that is, h, will be replaced by the first letter position of the particular replacement operator, that is, a, b, c, d, e, f or g for the operators 16*a*, 16*b*, 16*c*, 16*d*, 16*e*, 16*f* or 16*g*, respectively.

In several exemplary embodiments, when the cover 14 is closed and secured to the enclosure body 12, the operators 16*a*, 16*b*, 16*c*, 16*d*, 16*e*, 16*f*, 16*g* are aligned with the sliders 32*a*, 32*b*, 32*c*, 32*d*, 32*e*, 32*f* and 32*g*, respectively, in a manner similar to the manner in which the operator 16*h* is aligned with the slider 32*h*.

In several exemplary embodiments, the remainder of the operators 16 and sliders 32 shown in FIGS. 1 and 2, and the respective circuit breakers 28 hidden from view and beneath the respective sliders 32, and the arrangements therebetween, are substantially similar to the above-described operators 16*a*, 16*b*, 16*c*, 16*d*, 16*e*, 16*f*, 16*g* and 16*h*, the sliders 32*a*, 32*b*, 32*c*, 32*d*, 32*e*, 32*f*, 32*g* and 32*h*, and the circuit breakers 28*a*, 28*b*, 28*c*, 28*d*, 28*e*, 28*f*, 28*g* and 28*h*, and the arrangements therebetween, respectively.

In several exemplary embodiments, the arrangement of the circuit breakers 28, the sliders 32 and the operators 16 may vary widely, and the quantity of each may be modified. In an exemplary embodiment, one or more of the operators 16*a*, 16*b*, 16*c*, 16*d*, 16*e*, 16*f*, 16*g* and 16*h*, the sliders 32*a*, 32*b*, 32*c*, 32*d*, 32*e*, 32*f*, 32*g* and 32*h*, and/or the circuit breakers 28*a*, 28*b*, 28*c*, 28*d*, 28*f*, 28*g* and 28*h* may be removed from the panelboard 10. In an exemplary embodiment, the quantity of the circuit breakers in the plurality of circuit breakers 28 may be increased, which may necessitate a modification of the plate member 30, the strip 34, the enclosure body 12 and/or the cover 14, and which may further necessitate a corresponding increase in the quantity of the operators 16 and/or the sliders 32.

Figure 13B:
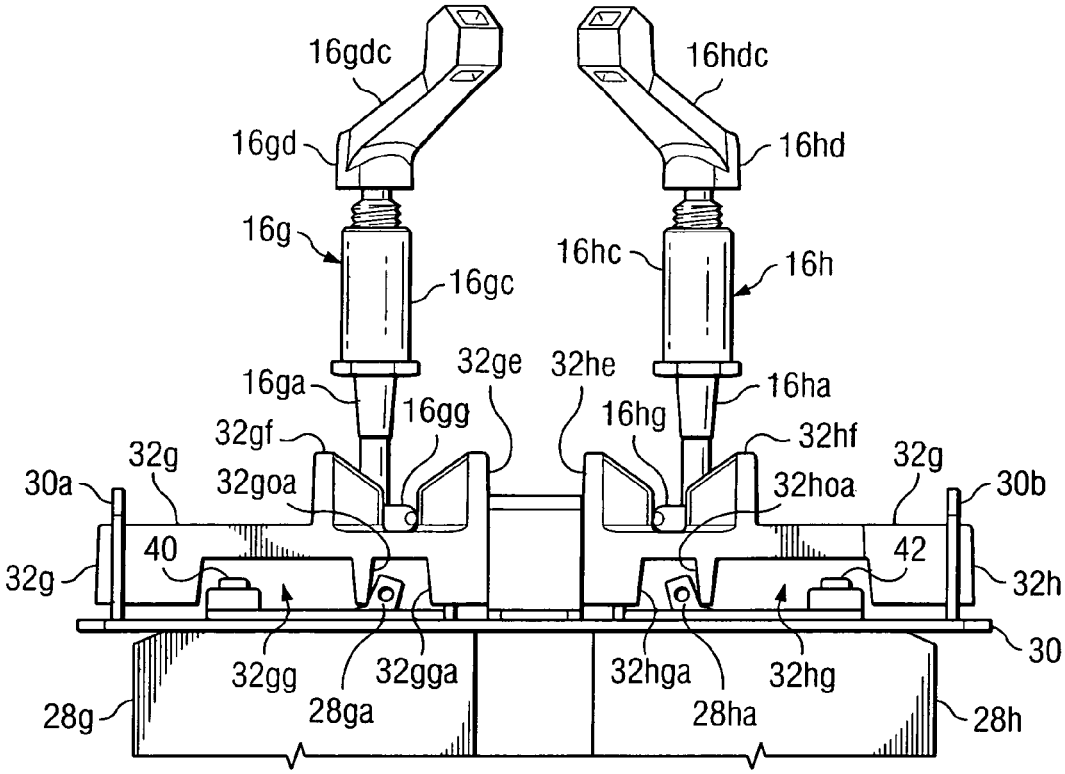
FIG. 13B is a plan view of the portion of the components depicted in FIG. 13A.

In an exemplary embodiment, when the panelboard 10 is in its assembled condition as illustrated in FIGS. 13A and 13B, the circuit breakers 28*a*, 28*b*, 28*c*, 28*d*, 28*e*, 28*f*, 28*g* and 28*h* are arranged in a symmetric configuration, with the circuit breakers 28*a*, 28*c*, 28*e* and 28*g* symmetric to the circuit breakers 28*b*, 28*d*, 28*f* and 28*h*, respectively, about the center bar 30*e*. However, the sliders 32*a*, 32*b*, 32*c*, 32*d*, 32*e*, 32*f*, 32*g* and 32*h* are not arranged in a symmetric configuration because of the polarity associated with each of the end portions 32*ac*, 32*bc*, 32*cc*, 32*dc*, 32*ec*, 32*fc*, 32*gc* and 32*hc*. That is, the sliders 32*a*, 32*c*, 32*e* and 32*g* are not symmetric to the sliders 32*b*, 32*d*, 32*f* and 32*h*, respectively, about the center bar 30*e*. Instead, the sliders 32*a*, 32*c*, 32*e* and 32*g* are oriented so that they are rotated 180 degrees from the sliders 32*b*, 32*d*, 32*f* and 32*h*, respectively, about an imaginary axis that is parallel to the center axis 16*hag* of the shaft 16*ha* of the operator 16 when the cover 14 is closed and secured to the enclosure body 12.

In an exemplary embodiment, each of the circuit breakers in the plurality of circuit breakers 28 may be in the form of a wide variety of circuit breakers. As shown in FIGS. 13A and 13B, the circuit breakers 28*a*, 28*b*, 28*c* and 28*d* are in the form of standard circuit breakers and the circuit breakers 28*e*, 28*f*, 28*g* and 28*h* are in the form of GFI circuit breakers, and include breaker test buttons 36, 38, 40 and 42, respectively. In an exemplary embodiment, the circuit breakers 28*e*, 28*f*, 28*g* and 28*h* may be in the form of EPD circuit breakers. The circuit breaker 28*g* includes a switch 28*ga*. In an exemplary embodiment, one or more of the circuit breakers 28*a*, 28*b*, 28*c*, 28*d*, 28*e*, 28*f*, 28*g* and 28*h* may be in the form of Cutler Hammer BAB Series Breakers.

Due to the above-described extension of the pin 16*hg* of the operator 16 between the protrusions 32*he* and 32*hf* of the slider 32*h*, the center axis 16*hag* of the shaft 16*ha* of the operator 16*h* is spaced from the centerline of the switch 28*ha* which, in turn, is collinear with the centerline of the slider 32*h*, by a predetermined spacing 44. In an exemplary embodiment, the centerline line of the switch 28*ha* may be collinear with both the centerline of the circuit breaker 28*h* and the centerline of the slider 32*h*. In an exemplary embodiment, the predetermined spacing 44 may be about 0.5 inches, and the corresponding spacings between the centerlines of the switches of the circuit breakers 28*a*, 28*b*, 28*c*, 28*d*, 28*e*, 28*f* and 28*g* and the center axes 16*aag*, 16*bag*, 16*cag*, 16*dag*, 16*eag*, 16*fag* and 16*gag*, respectively, may also be about 0.5 inches. In an exemplary embodiment, the center axis 16*hag* of the shaft 16*ha* of the operator 16*h* may extend between the circuit breakers 28*f* and 28*h*. In an exemplary embodiment, the circuit breakers 28*f* and 28*h* are positioned in a compact arrangement in which the circuit breakers contact or nearly contact each other, and the center axis 16*hag* extends between the circuit breakers 28*f* and 28*h* by extending along the imaginary plane of contact or near contact between the circuit breakers. In an exemplary embodiment, the circuit breaker 28*h* may define a width 45. In an exemplary embodiment, the spacing 44 may be substantially equal to about half of the width 45, thereby accommodating the compact arrangement between the circuit breakers 28*f* and 28*h*. In an exemplary embodiment, the width 45 may be about 1 inch and the spacing 44 may be about 0.5 inches. In an exemplary embodiment, the width 45 may be about 3 inches and the spacing 44 may be about 1.5 inches.

The angularly-extending portions 16*adc* and 16*bdc* of the handles 16*ad* and 16*bd*, respectively, permit the handles 16*cd* and 16*dd*, respectively, to extend beneath the angularly-extending portions, thereby nesting with the handles 16*ad* and 16*bd*, respectively. Likewise, the angularly-extending portions 16*edc* and 16*fdc* of the handles 16*ed* and 16*fd*, respectively, permit the handles 16*gd* and 16*hd*, respectively, to extend beneath the angularly-extending portions, thereby nesting with the handles 16*ed* and 16*fd*, respectively, in order to, for example, accommodate the compact arrangement between the circuit breakers 28*f* and 28*h*. Although not shown in FIG. 13A, all of the handles of the operators 16 that are positioned below the operators 16*a* and 16*b* are permitted to nest, in a manner similar to the foregoing, with corresponding handles immediately thereabove.

In an exemplary embodiment, the operators 16*a*, 16*b*, 16*c*, 16*d*, 16*e*, 16*f*, 16*g* and 16*h* are aligned with the sliders 32*a*, 32*b*, 32*c*, 32*d*, 32*e*, 32*f*, 32*g* and 32*h*, without staggering the operators 16, that is, without offsetting the operators 16 to the left or right of each other as viewed in FIG. 13A, so that the relative positions of the operators 16 correspond to the relative positions of the respective sliders 32 and thus the relative positions of the respective circuit breakers 28. In an exemplary embodiment, this correspondence may facilitate the operation of the sliders 32, and the respective circuit breakers 28, by, for example, enabling an operator of the panelboard 10 to quickly and easily determine which operator 16 controls which circuit breaker 28. In several exemplary embodiments, this correspondence between the operators 16 and the respective sliders 32 and circuit breakers 28 is possible even when each circuit breaker 28 that is positioned directly beneath another circuit breaker 28 contacts or nearly contacts the another circuit breaker 28, thereby accommodating a compact arrangement of the circuit breakers 28.

During operation, each of the circuit breakers 28*a*, 28*b*, 28*c* and 28*d* may be in one of at least four operational modes: an on operational mode, a trip operational mode, an off operational mode, and a reset operational mode. Correspondingly, each of the switches of the circuit breakers 28*a*, 28*b*, 28*c* and 28*d*, and the sliders 32*a*, 32*b*, 32*c* and 32*d*, may be in one of at least four positions: an on position, a trip position, an off position, and a reset position. In an exemplary embodiment, the reset operational mode of the circuit breakers 28*a*, 28*b*, 28*c* and 28*d* may be a temporary mode. Each of the circuit breakers 28*e*, 28*f*, 28*g* and 28*h* may be in one of at least four operational modes: an on operational mode, a trip operational mode, an off operational mode, and a reset operational mode. Correspondingly, each of the switches of the circuit breakers 28*e*, 28*f*, 28*g* and 28*h*, including each of the switches 28*ga* and 28*ha* of the circuit breakers 28*g* and 28*h*, respectively, may be in one of at least four operational positions: an on position, a trip position, an off position, and a reset position. Moreover, each of the sliders 32*e*, 32*f*, 32*g* and 32*h* may be in one of at least four corresponding operational positions: an on position, a trip position, an off position, and a reset position. In an exemplary embodiment, the trip positions of the sliders 32 are shown in FIG. 2. In an exemplary embodiment, the reset operational mode of the circuit breakers 28*e*, 28*f*, 28*g* and 28*h* may be a temporary mode.

In exemplary embodiment, as shown in FIGS. 13A and 13B, the circuit breakers 28*a*, 28*b*, 28*c*, 28*d*, 28*e*, 28*f*, 28*g* and 28*h* are each initially in the on operational mode. As a result, the switches 28*ga* and 28*ha*, and the sliders 32*g* and 32*h*, are each initially in the on position. The switch 28*ha* extends into the region 32*hp* and the contact surface 32*hoa* engages the switch. Similarly, the switch 28*ga* extends into the region 32*gp* and the contact surface 32*goa* engages the switch. The buttons 40 and 42 extend into the regions 32*gq* and 32*hq*, respectively. In an exemplary embodiment, the engagement between the switch 28*ha* and the contact surface 32*hoa* may prevent the slider 32*h* from moving any further to the left, and the engagement between the switch 28*ga* and the contact surface 32*goa* may prevent the slider 32*g* from moving any further to the right. In an exemplary embodiment, the engagement between the projection 30*eaa* and the slider 32*h* may prevent the slider 32*h* from moving any further to the left, and the engagement between a respective projection in the plurality of projections 30*ea* and the slider 32*g* may prevent the slider 32*g* from moving any further to the right. In an exemplary embodiment, the engagement between the projection 34*caa* and the slider 32*h* may prevent the slider 32*h* from moving any further to the left, and the engagement between a respective projection in the plurality of projections 34*ca* and the slider 32*g* may prevent the slider 32*g* from moving any further to the right. The relative positions of the sliders 32*a* and 32*b*, 32*c* and 32*d*, and 32*e* and 32*f*, are similar to the relative positions of the sliders 32*g* and 32*h* and therefore will not be described in detail.

The handle 16*hd* is angularly positioned so that an angle 46 is defined between a centerline of the handle and an imaginary vertical line that is parallel to the center bar 30*e*. In an exemplary embodiment, the angle 46 is about 29 degrees. The angular position of the handle 16*fd* is identical to the angular position of the handle 16*hd*, and the angular positions of the handles 16*ed* and 16*gd* are symmetric to the handles 16*fd* and 16*hd*, respectively, about the center bar 30*e*.

The handle 16*bd* is angularly positioned so that an angle 48 is defined between a centerline of the handle and an imaginary vertical line that is parallel to the center bar 30*e*. In an exemplary embodiment, the angle 48 is about 23 degrees. The angular position of the handle 16*dd* is identical to the angular position of the handle 16*ad*, and the angular positions of the handles 16*ad* and 16*cd* are symmetric to the handles 16*bd* and 16*dd*, respectively, about the center bar 30*e*.

In an exemplary embodiment, the handles 16*ad*, 16*c*, 16*ed* and 16*gd* are prevented from rotating any further in a counterclockwise direction by the wall 18*b* of the lockout plate 18, and the handles 16*bd*, 16*dd*, 16*fd* and 16*hd* are prevented from rotating any further in a clockwise direction by the wall 20*a* of the lockout plate 20. In an exemplary embodiment, devices such as, for example, locks, may be connected to the lockout plates 18 and/or 20 in order to prevent any rotation in any direction of one or more of the handles of the operator 16.

In several exemplary embodiments, the values of the angles 46 and 48 may be equal and/or may vary widely and may be dependent upon a wide variety of factors such as, for example, the design and/or manufacturer of the respective circuit breaker. Moreover, the value of each angle between an imaginary vertical line that is parallel to the center bar 30*e* and a handle of an operator 16 may be different than one or more of the other handles of the other operators 16.

The sliders 32*g* and 32*h* are positioned, relative to the plate member 30, so that the end portions 32*gc* and 32*hc* overlap, enabling the sliders to be positioned relatively close to one another when the respective circuit breakers 28*g* and 28*h* are in the on position. The sliders 32*a* and 32*b*, 32*c* and 32*d*, and 32*e* and 32*f*, are positioned in a manner similar to the sliders 32*g* and 32*h*, respectively.

The slot 32*hl* of the slider 32*h* permits access to the button 42 when the circuit breaker 28*h* is in its on position. In an exemplary embodiment, when the circuit breaker 28*h* is in its on position, the button 42 may be activated in a conventional manner and/or using any conventional device such as, for example, using a conventional pushbutton or plunger extending through and coupled to the cover 14, and at least partially extending within the slot 32*hl*. Similarly, the slots 32*el*, 32*fl* and 32*gl* permit access to the buttons 36, 38 and 40, respectively, when the respective circuit breakers 28*e*, 28*f* and 28*g* are in their on position. In an exemplary embodiment, if the circuit breakers 28*a*, 28*b*, 28*c* and 28*d* included breaker test buttons, then the slots 32*al*, 32*bl*, 32*cl* and 32*dl* would permit access to the respective test buttons.

In an exemplary embodiment, to change the operational mode of the circuit breaker 28*h* from the on operational mode as illustrated in FIGS. 13A and 13B to an off operational mode as illustrated in FIGS. 14A and 14B, the slider 32*h* is actuated when the cover 14 is closed and secured to the enclosure body 12. More particularly, the handle 16*hd* of the operator 16*h* is rotated counterclockwise so that the shaft 16*ha* rotates in place about its longitudinal center axis 16*hag*. In an exemplary embodiment, the handle 16*hd* is permitted to rotate, without interfering with the handle 16*fd* of the operator 16*f*, because of the above-described nesting arrangement between the handles 16*fd* and 16*hd*. In an exemplary embodiment, the bearing 16*hc* supports the shaft 16*ha* before, during and after the rotation of the shaft.

As a result of the rotation of the handle 16*hd* and the shaft 16*ha*, the pin 16*hg* rotates counterclockwise along with the shaft 16*ha*. During the rotation of the pin 16*hg*, the cam lobe 16*hgb* cammingly engages the protrusion 32*hf*, thereby actuating the slider 32*h*. Due to this actuation, the slider 32*h* is forced to slide to the right, as viewed in FIG. 13A, relative to and slidingly engaging the plate member 30, and translate away from the center bar 30*e*. In an exemplary embodiment, the slider 32*h* may slidingly engage the U-shaped center bar 30*e* of the plate member 30 and a surface of the wall 30*b* of the plate member 30 that is defined by the opening 30*baa*. In an exemplary embodiment, during the camming engagement between the cam lobe 16*hgb* and the protrusion 32*hf*, the cam lobe may contact and slidingly engage the surfaces 32*hfc* and/or 32*hfd* of the protrusion. Moreover, during the camming engagement between the cam lobe 16*hg* and the protrusion 32*hf*, the cam lobe may contact and slidingly engage the surfaces 32*hec* and/or 32*hed* of the protrusion 32*he*.

In an exemplary embodiment, during the rotation of the pin 16*hg*, the planar surface 16*hgf* of the pin 16*hg* remains positioned proximate the slider 32*h* and may slidingly engage the slider 32*h* in the region defined by the angle 32*hk*.

In an exemplary embodiment, during the translation of the slider 32*h* and the resulting sliding engagement between the slider and the plate member 30, the projections 30*eaa* and 34*caa* may guide the slider, thereby facilitating a substantially straight direction of translation and substantially preventing any unwanted interference between the slider 32*h* and the slider 32*f* and/or the any other components in the vicinity of the slider 32*h*. The wall member 30*b* may also facilitate the guidance of the slider 32*h* because of the extension of the end portion 32*ha* through the opening 30*baa*.

In an exemplary embodiment, during the counterclockwise rotation of the operator 16 including the rotation of the handle 16*hd*, the shaft 16*ha* and the pin 16*hg*, and the resulting translation of the slider 32*h*, the contact surface 32*hga* of the middle portion 32*hg* of the slider 32*h* applies a force against the switch 28*ha* of the circuit breaker 28*h*, thereby placing the switch in the off operational position and placing the circuit breaker in the off operational mode.

In an exemplary embodiment, any further translation of the slider 32*h* in a direction away from the center bar 30*e* may be prevented by the engagement between the contact surface 32*hga* and the switch 28*ha*. In an exemplary embodiment, any further translation of the slider 32*h* in a direction away from the center bar 30*e* may be prevented by the engagement of the shoulders 32*hm* and 32*hn* of the slider 32*h* with the wall 30*b* of the plate member 30. In an exemplary embodiment, any further rotation of the handle 16*hd* and the resulting translation of the slider 32*h* may be prevented by the engagement of the handle 16*hd* with the wall 20*b* of the lockout plate 20.

In an exemplary embodiment, the sliders 32*b*, 32*d* and 32*f* are actuated, in a direction away from the center bar 30*e*, in a manner similar to the manner in which the slider 32*h* is actuated and therefore the actuation of the sliders 32*b*, 32*d* and 32*f* will not be described in detail. In an exemplary embodiment, the sliders 32*a*, 32*c*, 32*e* and 32*g* are actuated, in a direction away from the center bar 30*e*, in a manner similar to the manner in which the sliders 32*b*, 32*d*, 32*f* and 32*h*, respectively, are actuated and therefore the actuation of the sliders 32*b*, 32*d*, 32*f* and 32*h* will not be described in detail. However, the respective operators 16*a*, 16*c*, 16*e* and 16*g* are rotated clockwise, rather than counterclockwise, due to the above-described symmetric arrangement between the handles 16*ad*, 16*cd*, 16*ed* and 16*gd*, and the handles 16*bd*, 16*dd*, 16*fd* and 16*hd*, respectively. Moreover, the operational modes of the circuit breakers 28*b*, 28*d* and 28*f* are changed from their respective on operational modes to their respective off operational modes in a manner substantially similar to the manner in which the operational mode of the circuit breaker 28*h* is changed from its on operational mode to its off operational mode.

In exemplary embodiment, once the circuit breakers 28*a*, 28*b*, 28*c*, 28*d*, 28*e*, 28*f*, 28*g* and 28*h* are placed in their off operational modes, as illustrated in FIGS. 14A and 14B, the switches 28*ga* and 28*ha*, and the sliders 32*g* and 32*h*, are in their off positions. More particularly, the switch 28*ha* extends into the region 32*hp* and the contact surface 32*hga* of the middle portion 32*hg* of the slider 32*h* engages the switch. Similarly, the switch 28*ga* extends into the region 32*gp* and the contact surface 32*gga* engages the switch. In an exemplary embodiment, the engagement between the switch 28*ha* and the contact surface 32*hga* may prevent the slider 32*h* from moving any further to the right, and the engagement between the switch 28*ga* and the contact surface 32*gga* may prevent the slider 32*g* from moving any further to the left. In exemplary embodiment, the engagement between the projection 30*eaa* and the slider 32*h* may prevent the slider 32*h* from moving any further to the right, and the engagement between a respective projection in the plurality of projections 30*ea* and the slider 32*g* may prevent the slider 32*g* from moving any further to the left. In an exemplary embodiment, the engagement between the projection 34*caa* and the slider 32*h* may prevent the slider 32*h* from moving any further to the right, and the engagement between a respective projection in the plurality of projections 34*ca* and the slider 32*g* may prevent the slider 32*g* from moving any further to the left. The relative positions of the sliders 32*a* and 32*b*, 32*c* and 32*d*, and 32*e* and 32*f*, are similar to the relative positions of the sliders 32*g* and 32*h* and therefore will not be described in detail.

The handle 16*hd* is angularly positioned so that an angle 50 is defined between a centerline of the handle and an imaginary vertical line that is parallel to the center bar 30*e*. In an exemplary embodiment, the angle 50 is about 33 degrees. The angular position of the handle 16*fd* is identical to the angular position of the handle 16*hd*, and the angular positions of the handles 16*ed* and 16*gd* are symmetric to the handles 16*fd* and 16*hd*, respectively, about the center bar 30*e*.

The handle 16*bd* is angularly positioned so that an angle 52 is defined between a centerline of the handle and imaginary vertical line that is parallel to the center bar 30*e*. In an exemplary embodiment, the angle 52 is about 27 degrees. The angular position of the handle 16*dd* is identical to the angular position of the handle 16*ad*, and the angular positions of the handles 16*ad* and 16*cd* are symmetric to the handles 16*bd* and 16*dd*, respectively, about the center bar 30*e*.

In several exemplary embodiments, the value of the angles 50 and 52 may be equal and/or may vary widely and may be dependent upon a wide variety of factors such as, for example, the design and/or manufacturer of the respective circuit breaker. Moreover, the value of each angle between an imaginary vertical line that is parallel to the center bar 30*e* and a handle of an operator 16 may be different than one or more of the other handles of the other operators 16.

The sliders 32*g* and 32*h* are positioned, relative to the plate member 30, so that the end portions 32*gc* and 32*hc* continue to overlap when the circuit breakers 28*g* and 28*h* are in their off operational modes, but not to the extent with which the end portions 32*gc* and 32*hc* overlap when the circuit breakers 28*g* and 28*h* are in their on operational modes. The sliders 32*a* and 32*b*, 32*c* and 32*d*, and 32*e* and 32*f*, are positioned in a manner similar to the sliders 32*g* and 32*h*, respectively.

The slot 32*hl* of the slider 32*h* continues to permit access to the button 42 when the circuit breaker 28*h* is in its off operational mode. In an exemplary embodiment, a device for activating the button 42 such as, for example, a conventional pushbutton or plunger extending through and coupled to the cover 14, may continue to at least partially extend in the slot 32*hl* when the circuit breaker 28*h* is in its off operational mode. Similarly, the slots 32*el*, 32*fl* and 32*gl* permit access to the buttons 36, 38 and 40, respectively, when the respective circuit breakers 28*e*, 28*f* and 28*g* are in their off operational modes. In an exemplary embodiment, if the circuit breakers 28*a*, 28*b*, 28*c* and 28*d* included breaker test buttons, then the slots 32*al*, 32*bl*, 32*cl* and 32*dl* would permit access to the respective test buttons.

In an exemplary embodiment, the reset operational positions of the switches 28*ea*, 28*fa*, 28*ga* and 28*ha*, and the sliders 32*e*, 32*f*, 32*g* and 32*h*, may be equivalent to their respective off operational positions. As a result, the slots 32*el*, 32*fl*, 32*gl* and 32*hl* continue to permit access to the buttons 36, 38, 40 and 42, respectively, when the circuit breakers 28*e*, 28*f*, 28*g* and 28*h* are in their reset operational modes. In an exemplary embodiment, a device for activating the button 42 such as, for example, a conventional pushbutton or plunger extending through and coupled to the cover 14, may continue to at least partially extend in the slot 32*hl* when the circuit breaker 28*h* is in its reset operational mode.

In an exemplary embodiment, the handles 16*bd* and 16*dd* may be further rotated in a counterclockwise direction to continue to apply a force to and operate the switches 28*aa* and 28*ba*, respectively, to place the circuit breakers 28*a* and 28*b*, respectively, in their reset operational modes. In an exemplary embodiment, if the handles 16*bd* and 16*dd* are so rotated to place the circuit breakers 28*a* and 28*b* in their reset operational modes, then the value of the angle 50 may increase. In an exemplary embodiment, the value of the angle 50 may increase to about 30 degrees. In an exemplary embodiment, if the circuit breakers 28*a*, 28*b*, 28*c* and 28*d* included breaker test buttons, then the slots 32*al*, 32*bl*, 32*cl* and 32*dl* would continue to permit access to the respective test buttons when the circuit breakers 28*a*, 28*b*, 28*c* and 28*d* were placed in their reset operational modes.

In several exemplary embodiments, the values of the angles 50 and 52 may be equal and/or may vary widely and may be dependent upon a wide variety of factors such as, for example, the design and/or manufacturer of the respective circuit breaker. Moreover, the value of each angle between an imaginary vertical line that is parallel to the center bar 30*e* and a handle of an operator 16 may be different than one or more of the other handles of the other operators 16.

In an exemplary embodiment, when the circuit breakers 28*a*, 28*b*, 28*c*, 28*d*, 28*e*, 28*f*, 28*g* and 28*h* are in their reset operational modes, the handles 16*ad*, 16*cd*, 16*ed* and 16*gd* are prevented from rotating any further in a clockwise direction by the wall 18*a* of the lockout plate 18, and the handles 16*bd*, 16*dd*, 16*fd* and 16*hd* are prevented from rotating any further in a counterclockwise direction by the wall 20*b* of the lockout plate 20. In an exemplary embodiment, devices such as, for example, locks, may be connected to the lockout plates 18 and/or 20 in order to prevent any rotation in any direction of one or more of the handles of the operator 16.

In an exemplary embodiment, if it is desired to place one or more of the circuit breakers 28*a*, 28*b*, 28*c*, 28*d*, 28*e*, 28*f*, 28*g* and 28*h* in their on operational modes, the above-described steps are carried out in reverse, that is, the handles 16*ad*, 16*cd*, 16*ed* and 16*gd* are rotated counterclockwise and the handles 16*bd*, 16*dd*, 16*fd* and 16*hd* are rotated clockwise, so that the respective sliders 32 are actuated and the respective switches of the circuit breakers 28, the respective operators 16 and the respective sliders 32 are again placed in the positions shown in FIGS. 13A and 13B. In an exemplary embodiment, one or more of the circuit breakers 28*a*, 28*b*, 28*c*, 28*d*, 28*e*, 28*f*, 28*g* and 28*h* may be placed in their trip operational modes by, for example, the one or more of the circuit breakers 28 electrically tripping during normal circuit-breaker operation. In an exemplary embodiment, the circuit breakers 28*e*, 28*f*, 28*g* and/or 28*h* may be placed in their trip operational modes, from their on operational modes, as a result of, for example, the buttons 36, 38, 40 and/or 42, respectively, being pressed or the circuit breakers 28*e*, 28*f*, 28*g* and/or 28*h* electrically tripping. As a result, the handles 16*ed* and/or 16*gd* rotate clockwise and the handles 16*f* and/or 16*hd* rotate counterclockwise, and the respective sliders 32 are placed in their trip positions, that is, between their respective off and on positions, as shown in FIG. 2, and the switches of the circuit breakers 28 are placed in their trip positions, that is, extending in straight directions that are perpendicular to the respective circuit breakers 28, so that the angle 46 is about 0 degrees. In an exemplary embodiment, the slot 32*hl* of the slider 32*h* continues to permit access to the button 42 when the circuit breaker 28*h* is in its trip operational mode. In an exemplary embodiment, a device for activating the button 42 such as, for example, a conventional pushbutton or plunger extending through and coupled to the cover 14, may continue to at least partially extend in the slot 32*hl* when the circuit breaker 28*h* is in its trip operational mode. Similarly, the slots 32*el*, 32*fl* and 32*gl* permit access to the buttons 36, 38 and 40, respectively, when the respective circuit breakers 28*e*, 28*f* and 28*g* are in their trip operational modes. In an exemplary embodiment, if the circuit breakers 28*a*, 28*b*, 28*c* and 28*d* included breaker test buttons, then the slots 32*al*, 32*bl*, 32*cl* and 32*dl* would permit access to the respective test buttons. In an exemplary embodiment, the initial operational mode of the circuit breaker 28*h*, and the above-described order in which the circuit breaker 28*h* is placed in its different operational modes, is arbitrarily chosen for illustration purposes, and a wide variety of initial conditions and/or operational orders is possible for the circuit breaker 28*h*. In several exemplary embodiments, the circuit breakers 28*a*, 28*b*, 28*c*, 28*d*, 28*e*,

28*f*, 28*g* and 28*h* may each initially be placed in any one of the above-described operational modes of the circuit breakers 28, and such initial operational modes may be changed to any other of the above-described operational modes of the circuit breakers 28, and so on, in a wide variety of orders of operational modes.

In an exemplary embodiment, the above-described close alignment of the operators 16*a*, 16*b*, 16*c*, 16*d*, 16*e*, 16*f*, 16*g* and 16*h* with the sliders 32*a*, 32*b*, 32*c*, 32*d*, 32*e*, 32*f*, 32*g* and 32*h*, respectively, does not interfere with the ability of a slider to permit access to a breaker test button, if present on a respective circuit breaker 28, at any one of the operational modes of the respective circuit breaker. Thus, access to a breaker test button, if present, is always permitted across the full range of motion of a respective slider in the plurality of sliders 32. As a result, in an exemplary embodiment, a device for activating the button 42 such as, for example, a conventional pushbutton or plunger extending through and coupled to the cover 14, may always at least partially extend in the slot 32*hl*, and the slider 32*h* may translate relative thereto, during all of the operational modes of the circuit breaker 28*h*, including the on, trip, off and reset operational modes, thereby reducing the amount of travel needed for the pushbutton or plunger to activate the button 42, and/or decreasing the likelihood that the pushbutton or plunger will damage the slider 32*h* before, during and/or after the activation of the button 42. In an exemplary embodiment, in addition to, or instead of the slot 32*hl*, one or more other openings such as, for example, one or more holes, may be formed in the slider 32*h* to permit access to the to the button 42 during all of the operational modes of the circuit breaker 28*h*.

In an exemplary embodiment, the cover 14 may be opened, exposing the chamber 22 of the enclosure body 12 to view, while the circuit breakers 28*a*, 28*b*, 28*c*, 28*d*, 28*e*, 28*f*, 28*g* and 28*h* remain in their off operational modes as shown in FIGS. 14A and 14B, and the respective sliders 32*a*, 32*b*, 32*c*, 32*d*, 32*e*, 32*f*, 32*g* and 32*h* remain in the positions shown in FIGS. 14A and 14B.

Figure 15:
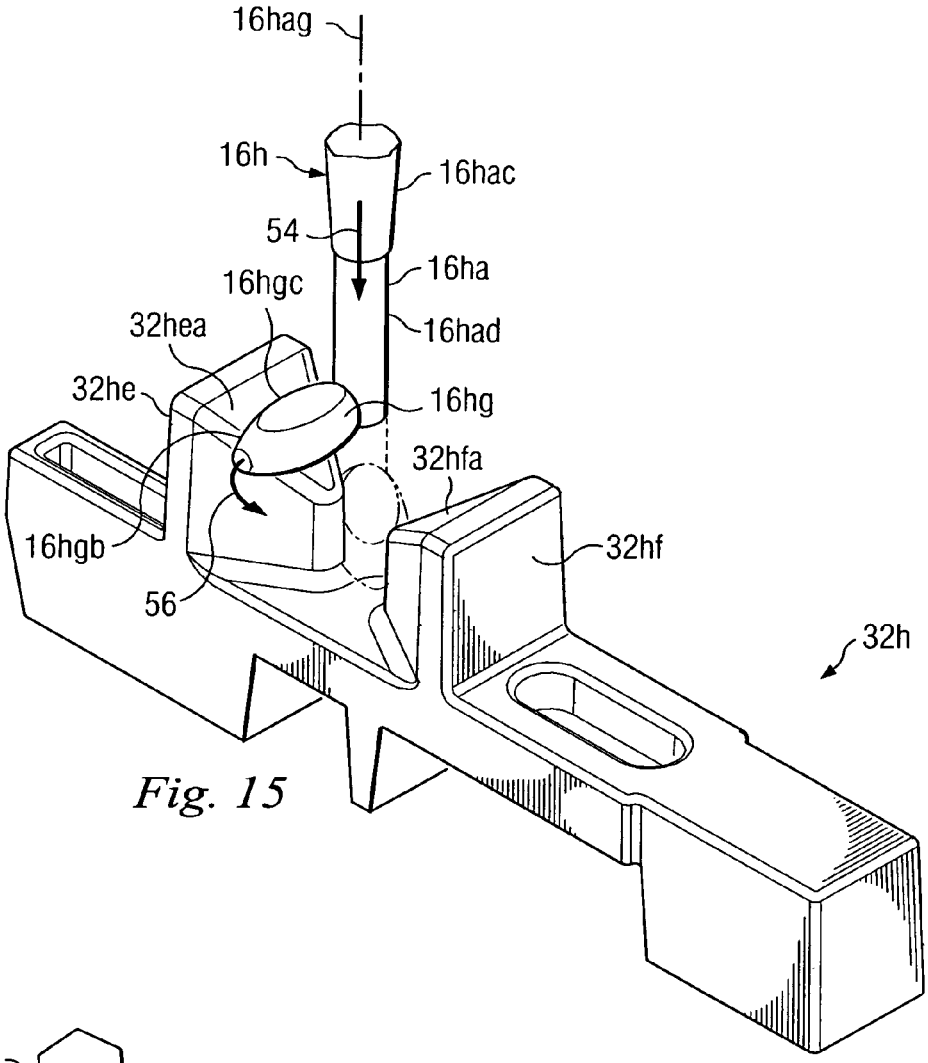
FIG. 15 is a perspective view depicting an operational engagement of the operator of FIG. 9 and the slider of FIGS. 5-8.
Figure 17:
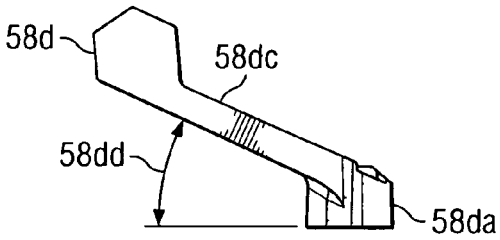
FIG. 17 is an elevational view of a handle of the operator of FIG. 16.
Figure 18:
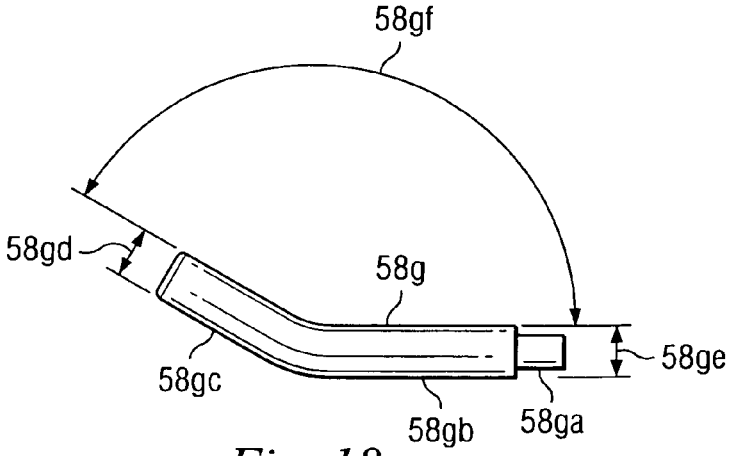
FIG. 18 is a top plan view of a pin of the operator of FIG. 16.

In an exemplary embodiment, as illustrated in FIG. 15, when the cover 14 is opened, the operator 16*h* is moved away from the slider 32*h* and the pin 16*hg* of the operator 16*h* no longer extends between the protrusions 32*he* and 32*hf* of the slider 32*h*, while the position of the slider 32*h* remains unchanged. During the movement of the operator 16*h* away from the slider 32*h*, in an exemplary embodiment, gravity may cause the pin 16*hg* to rotate about the center axis 16*hag* of the shaft 16*ha* because the pin no longer extends between or is supported by the protrusions 32*he* and/or 32*hf*. If the slider 32*h* is in an off position corresponding to the off operational position of the switch 28*ha* of the circuit breaker 28*h*, then the pin 16*hg* may rotate clockwise until the pin extends downward in a direction perpendicular to the direction of translation of the slider 32*h*. The cover 14 may then be closed, during which time the operator 16*h* moves back towards the slider 32*h*, as shown in FIG. 15. During this movement, the shaft 16*ha* of the operator 16*h* approaches the slider 32*h*, as indicated by an approach arrow 54, and the pin 16*hg* accordingly approaches the slider while still extending downward in a direction that is perpendicular to the direction of translation of the slider. The pin 16*hg* contacts the ramp surface 32*hea*. The engagement between the ramp surface 32*hea* and the pin 16*hg*, including the base 16*hgc* and/or the cam lobe 16*hgb*, and the continuing approach of the shaft 16*ha*, causes the pin to rotate in a counterclockwise direction, about the shaft 16*ha* and as indicated by a rotation arrow 56, and simultaneously slide along and off of the ramp surface, as the shaft 16*ha* continues its approach as indicated by the arrow 54, until the pin at least partially extends between the protrusions 32*he* and 32*hf* and the planar surface 16*hgf* is proximate or contacting the slider 32. As a result, in response to the closing of the cover 14, the operator 16*h* automatically adjusts to a position corresponding to the off operational mode of the circuit breaker 28*h*, the off operational position of the switch 28*ha* and the corresponding off position of the slider 32*h*, so that the positions of the switch 28*ha* and the slider 32*h* remain unchanged and constant after the engagement of the operator 16*h* with the slider 32*h*. In an exemplary embodiment, after the self adjustment of the operator 16*h*, the slider 32*h* may be actuated using the operator 16*h*, as described above. For example, if the operator 16*h* automatically adjusted to the position shown in FIG. 15, that is, corresponding to the off position of the slider 32*h*, the handle 16*hd* could then be rotated clockwise to actuate the slider 32*h* and place the slider in its on position.

In an exemplary embodiment, if the circuit breaker 28*h* was in its on operational mode, the switch 28*ha* was in its on operational position, and the slider 32*h* was in a position corresponding to the operational position of the switch, then the pin 16*hg* would instead contact the ramp surface 32*hfa* and rotate clockwise in response to the approach of the shaft 16*ha* towards the slider. During and upon the closing of the cover 14, the operator 16 would automatically adjust to a position corresponding to the on operational mode of the circuit breaker 28*h*, the on operational position of the switch 28*ha* and the corresponding on position of the slider 32*h*, so that the positions of the switch 28*ha* and the slider 32*h* remain unchanged and constant after the engagement of the operator 16*h* with the slider 32*h*.

In an exemplary embodiment, during the closing of the cover 14, the engagement of the operators 16*a*, 16*b*, 16*c*, 16*d*, 16*e*, 16*f* and 16*g* with the sliders 32*a*, 32*b*, 32*c*, 32*d*, 32*e*, 32*f* and 32*g*, respectively, is substantially similar to the above-described engagement between the operator 16*h* and the slider 32*h* and therefore will not be described in detail. In an exemplary embodiment, in addition to being placed in positions that correspond to the on and off operational modes of the circuit breakers 28*a*, 28*b*, 28*c* and 28*d*, the operators 16*a*, 16*b*, 16*c* and 16*d* may automatically adjust to positions that correspond to the reset operational modes of the respective circuit breakers upon the closing of the cover 14.

In an exemplary embodiment, during and upon the closing of the cover 14, the operators 16 self locate with the respective sliders 32, automatically adjusting to the position of each respective slider 32, regardless of the operational mode of the respective circuit breaker 28.

Figure 16:
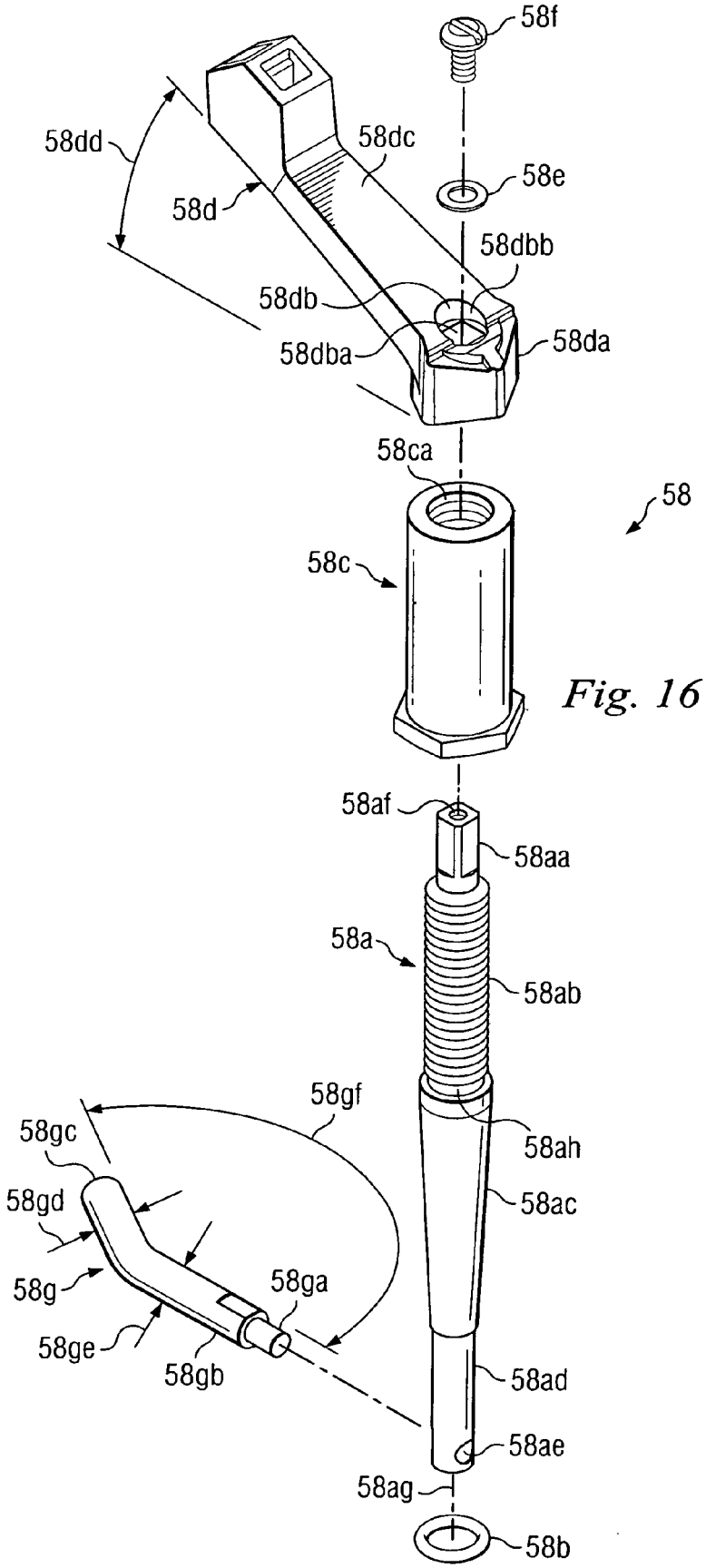
FIG. 16 is an exploded view of an operator according to another embodiment.

In an exemplary embodiment, as illustrated in FIG. 16, another embodiment of an operator is generally referred to by the reference numeral 58 and includes a shaft 58*a* including a proximal end portion 58*aa*, an external threaded connection 58*ab*, a tapered portion 58*ac* and a distal end portion 58*ad*, through which a through-hole 58*ae* extends. The exterior of the proximal end portion 58*aa* is substantially square-shaped, and an internal threaded connection 58*af* extends into the proximal end portion. The shaft 58*a* further includes a longitudinal center axis 58*ag* and an external annular recess 58*ah* positioned between the external threaded connection 58*ab* and the tapered portion 58*ac*.

An o-ring 58*b* is disposed in the external annular recess 58*ah*. A bearing 58*c* including an internal threaded connection 58*ca* is coupled to the shaft 58*a* so that the shaft extends through the bearing, with the external threaded connection 58*ab* being threadably engaged with the internal threaded connection 58*ca*. As a result, a portion of the external threaded connection 58*ab* extends outside of the bearing 58*c* and the o-ring 58*b* forms a sealing engagement between the bearing 58*c* and the external annular recess 58*ah*. In an exemplary embodiment, the external threaded connection 58*ab* may be threadably engaged with the internal threaded connection 58*ca* until the shaft 58*a* is in a fully-seated position in the bearing 58*c*, and then the external threaded connection 58*ab* is backed out from the fully-seated position in the bearing by a predetermined number of turns. In an exemplary embodiment, the predetermined number of turns may range from about 1 turn to about 4 turns. In an exemplary embodiment, the bearing 58*c* extends through the cover 14 and is coupled to the cover in a conventional manner.

A handle 58*d* includes a proximal end portion 58*da* and an opening 58*db* formed through the proximal end portion, the opening including a square-shaped through-portion 58*dba* and a countersunk portion 58*dbb*. An angularly-extending portion 58*dc* extends from the proximal end portion 58*da* and defines an angle 58*dd* between the angularly-extending portion and an imaginary plane that is perpendicular to the longitudinal center axis 58*ag* of the shaft 16*ha*. In an exemplary embodiment, the angle 58*dd* may be about 25.0 degrees.

The proximal end portion 58*da* of the handle 58*d* fits over the square-shaped proximal end portion 58*aa* of the shaft 58*a* so that the square-shaped proximal end portion 58*aa* extends into the square-shaped through-portion 58*dba* of the opening 58*db*. A washer 58*e* is received within the countersunk portion 58*dbb* of the opening 58*db* and a fastener such as, for example, a screw 58*f* extends through the opening 58*db* and is threadably engaged with the internal threaded connection 58*af* of the proximal end portion 58*aa* of the shaft 58*a*, thereby connecting the handle 58*d* to the shaft 58*a*.

A pin 58*g* includes a stem 58*ga* that extends through the bore 58*ae* to connect the pin to the shaft 58*a*. A cylindrical portion 58*gb* extends from the stem 58*ga*, and a cylindrical portion 58*gc* extends from the cylindrical portion 58*gb*. Diameters 58*gd* and 58*ge* are defined by the cylindrical portions 58*gb* and 58*gc*, respectively. In an exemplary embodiment, the diameters 58*gd* and 58*ge* may be substantially equal. In an exemplary embodiment, the diameters 58*gd* and 58*ge* may each be about 0.25 inches. Due to the different directions of extension of the cylindrical portions 58*gb* and 58*gc*, an angle 58*gf* is defined between the cylindrical portions 58*gb* and 58*gc*. In an exemplary embodiment, the angle 58*gf* may be about 150 degrees.

Figure 19:
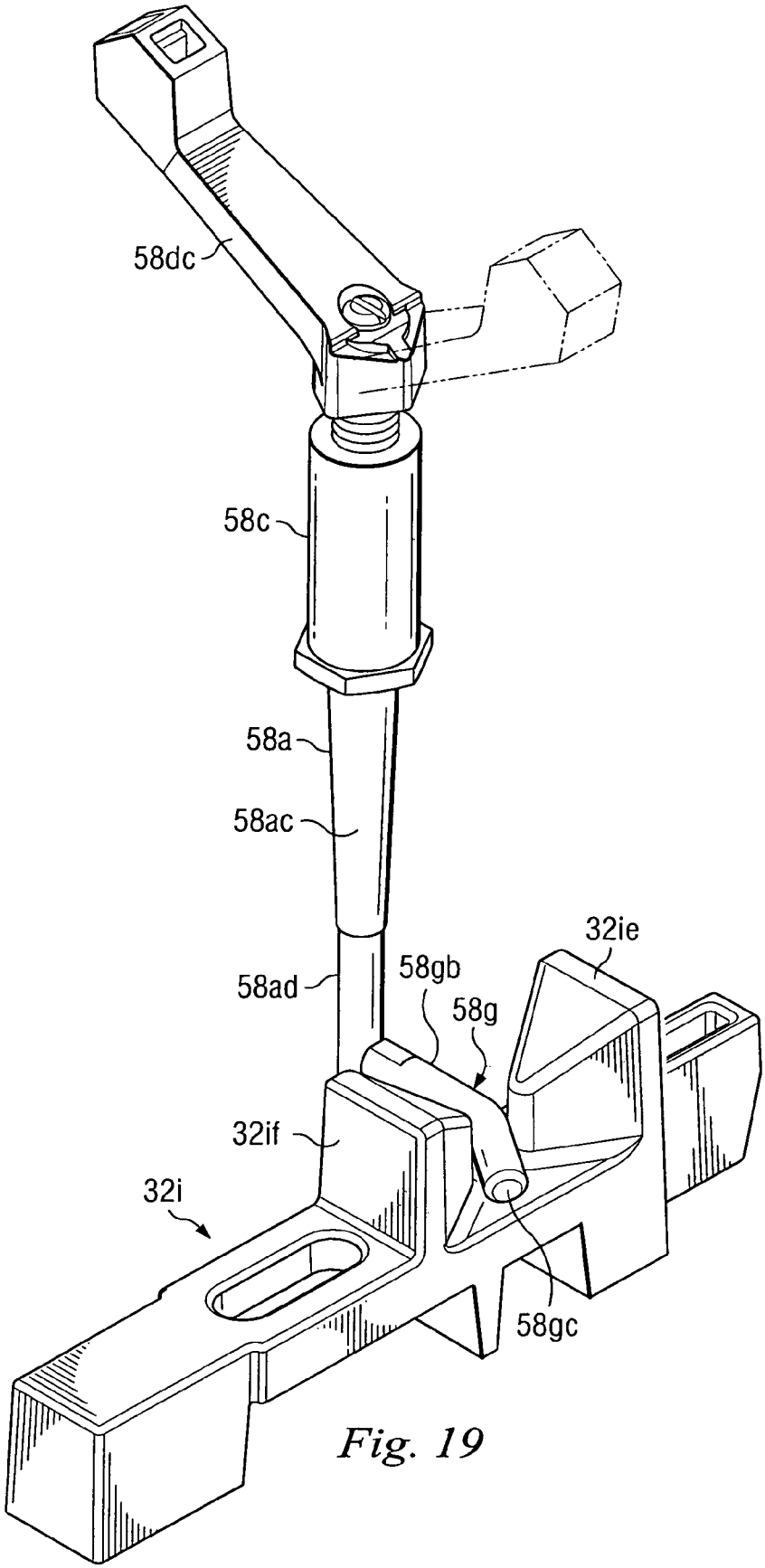
FIG. 19 is a perspective view of the operator of FIG. 16 and a slider that is similar to the slider of FIGS. 5-8.

In an exemplary embodiment, as illustrated in FIG. 19, the cylindrical portion 58*gb* extends from the shaft 58*a* so that the cylindrical portion 58*gb* and the handle 58*d* are not aligned, that is, the cylindrical portion 58*gb* and the handle 58*d* extend from the center axis 58*ag* of the shaft 58*a* in different directions that are, for example, 180 degrees apart. In an exemplary embodiment, the cylindrical portion 58*gb* and the handle 58*d* may be aligned, extending in the same direction from the center axis 58*ag*. The operator 58 is adapted to engage a slider 32*i*. In an exemplary embodiment, the slider 32*i* is substantially similar to the slider 32*h* and therefore will not be described in detail. In the description below, any reference numerals used to refer to features of the slider 32*i* will correspond to the reference numerals for the features of the slider 32*h*, except that the first letter position for the reference numerals used to describe the slider 32*h*, that is, h, will be replaced by the first letter position of the reference numeral for the slider 32*i*, that is, i. As shown in FIG. 19, when the cover 14 is closed, the cylindrical portion 58*gc* of the operator 58 extends between the protrusions 32*ie* and 32*if*.

Figure 20A:
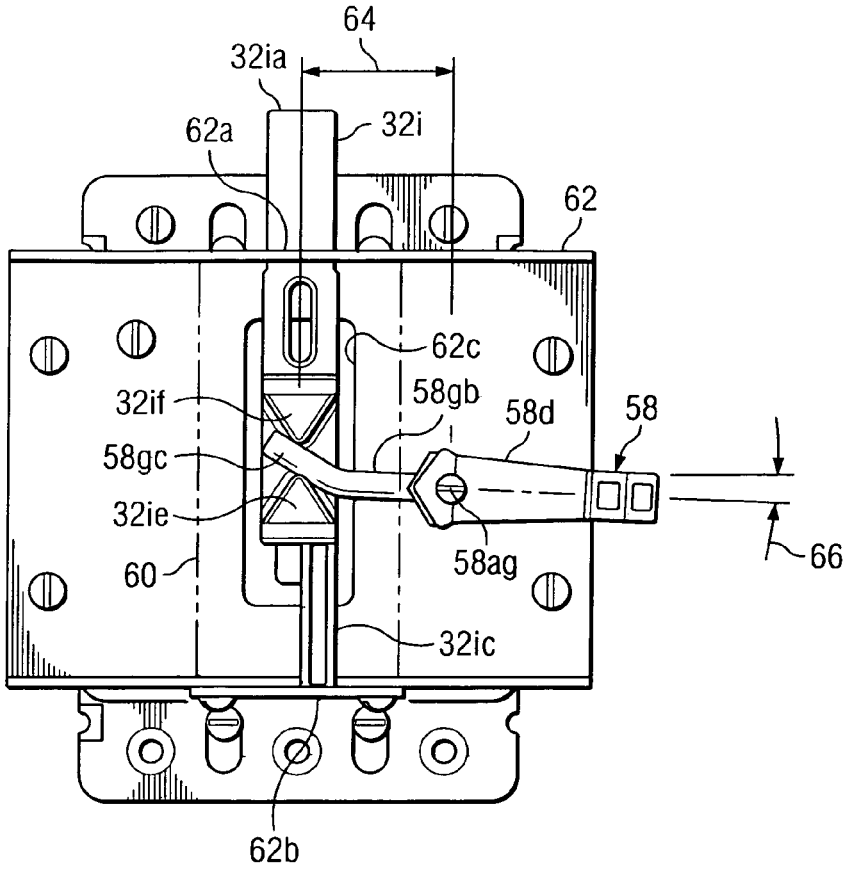
FIG. 20A is an elevational view of the operator of FIG. 16 in an operational position.

In an exemplary embodiment, as illustrated in FIG. 20A, the slider 32*i* is positioned over a circuit breaker 60, and the end portion 32*ia* of the slider 32*i* extends through an opening 62*a* in a U-shaped bracket 62, and the end portion 32*ic* of the slider 32*i* at least partially extends through an opening 62*b* in the U-shaped bracket. In an exemplary embodiment, the circuit breaker 60 may be in the form of a main circuit breaker. In an exemplary embodiment, the circuit breaker 60 and/or the bracket 62 may be connected to the mounting plate 24. In an exemplary embodiment, the circuit breaker may include one or more operational modes: an on operational mode, an off operational mode and a reset operational mode. In an exemplary embodiment, the circuit breaker 60 may be in the form of a Cutler Hammer 'F' Frame Breaker. In several exemplary embodiments, the circuit breaker 60 may be in a wide variety of forms of circuit breakers, including any forms of circuit breakers identified above.

As shown in FIG. 20A, the circuit breaker 60 is in its on operational mode. Due to the above-described extension of the cylindrical portion 58*gc* between the protrusions 32*ie* and 32*if* of the slider 32*i*, the center axis 58*ag* of the shaft 58*a* of the operator 58 is spaced from the centerline of the switch of the circuit breaker 60 (switch not shown) which, in turn, is collinear with the centerline of the slider 32*i*, by a predetermined spacing 64. In an exemplary embodiment, the predetermined spacing ranges from about 1.3 inches to about 1.6 inches. In an exemplary embodiment, the predetermined spacing is about 1.42 inches. In an exemplary embodiment, an opening 62*c* in the bracket 62 permits the slider 32*i* to engage the switch of the circuit breaker 60.

The handle 58*d* is angularly positioned so that an angle 66 is defined between the centerline of the handle and an imaginary horizontal line that is perpendicular to the direction of translation of the slider 32*i*. In an exemplary embodiment, the angle 66 is about 3 degrees.

Figure 20B:
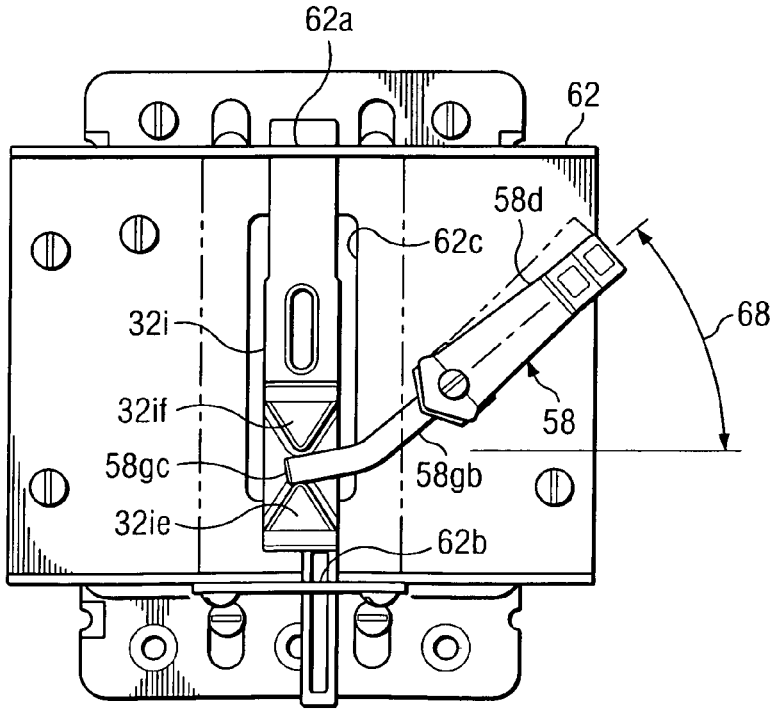
FIG. 20B is a view similar to that of FIG. 20A but depicting another operational position.

To change the operational mode of the circuit breaker 60 from the on operational mode as illustrated in FIG. 20A to an off operational mode as illustrated in FIG. 20B, the slider 32*i* is actuated. More particularly, the handle 58*d* of the operator 58 is rotated counterclockwise so that the shaft 58*a* rotates in place about its center axis 58*ag*. In an exemplary embodiment, in addition to, or instead of the circuit breaker 60, the operator 58 may be used with one or more of the circuit breakers in the plurality of circuit breakers 28. In an exemplary embodiment, the bearing 58*c* supports the shaft 58*a* before, during and after the rotation of the shaft.

As a result of the rotation of the handle 58*d* and the shaft 58*a*, the pin 58*g* rotates counterclockwise along with the shaft 58*a*. During the rotation of the pin 58*g*, the cylindrical portion 58*gc* cammingly engages the protrusion 32*ie*, thereby actuating the slider 32*i*. Due to this actuation, the slider 32*i* is forced to slide downward, as viewed in FIGS. 20A and 20B, relative to and slidingly engaging the bracket 62. In an exemplary embodiment, during the camming engagement between the cylindrical portion 58*gc* and the protrusion 32*ie*, the cylindrical portion may contact and slidingly engage the surfaces 32*iec* and/or 32*ied* of the protrusion. Moreover, during the camming engagement between the cylindrical portion 58*gc* and the protrusion 32*ie*, the cylindrical portion may contact and slidingly engage the surfaces 32*ifc* and/or 32*ifd* of the protrusion 32*if*.

In an exemplary embodiment, during the counterclockwise rotation of the operator 58 including the rotation of the handle 58*d*, the shaft 58*a* and the pin 58*g*, and the resulting translation of the slider 32*i*, the contact surface 32*ioa* of the projection 32*io* of the slider 32*i* applies a force against the switch of the circuit breaker 60, thereby placing the switch in the off operational position and placing the circuit breaker in the off operational mode.

In an exemplary embodiment, any further translation of the slider 32*i* in a downward direction, as viewed in FIG. 20A, may be prevented by the engagement between the contact surface 32*ioa* and the switch of the circuit breaker 60. In an exemplary embodiment, any further rotation of the handle 58*d* and the resulting translation of the slider 32*i* may be prevented by the engagement of the handle 16*hd* with a lock-out plate (not shown).

In exemplary embodiment, once the circuit breaker 60 is placed in its off operational mode as illustrated in FIG. 20B, the handle 58*d* is angularly positioned so that an angle 68 is defined between a centerline of the handle and an imaginary horizontal line that is perpendicular to the direction of translation of the slider 32*i*. In an exemplary embodiment, the angle 68 is about 41 degrees.

In an exemplary embodiment, the handle 58*d* may be further rotated in a counterclockwise direction to continue to apply a force to and operate the switch of the circuit breaker 60 to place the circuit breaker in its reset operational mode. In an exemplary embodiment, if the handle 58*d* is so rotated to place the circuit breaker 60 in its reset operational mode, then the value of the angle 68 may increase. In an exemplary embodiment, the value of the angle 68 may increase to about 45 degrees. In several exemplary embodiments, the values of the angles 66 and 68 may be equal and/or may vary widely and may be dependent upon a wide variety of factors such as, for example, the design and/or manufacturer of the circuit breaker 60.

In an exemplary embodiment, if it is desired to place the circuit breaker 60 in its on operational mode, the above-described steps are carried out in reverse, that is, the handle 58*d* is rotated clockwise so that the slider 32*i* is actuated and the operator 58 and the slider 32*i* are again placed in the positions shown in FIG. 20A.

In an exemplary embodiment, during and upon the closing of the cover 14, the operator 58 self locates with the slider 32*i*, automatically adjusting to the position of the slider, regardless of the operational mode of the circuit breaker 60, in a manner substantially similar to the manner in which each of the operators 16 self locate with the respective sliders 32, with the cylindrical portion 58*gc* engaging either the ramp surface 32*iea* or 32*ifa*, and rotating in response to this engagement and the approach of the operator 58 towards the slider 32*i*.

A system has been described that includes a slider positioned in one of at least two positions; a device adapted to approach and engage the slider; and means for automatically adjusting the device to a position corresponding to the one of the at least two positions of the slider during the device's approach and engagement with the slider so that the slider remains in the one of the at least two positions, wherein the device is permitted to actuate the slider when the device is in the position corresponding to the one of the at least two positions of the slider.

A system has been described that includes a slider positioned in one of at least two positions and comprising at least one protrusion; an enclosure in which the slider is disposed; a pin adapted to approach and engage the slider; and means for automatically adjusting the pin to a position corresponding to the one of the at least two positions of the slider during the pin's approach and engagement with the slider so that the slider remains in the one of the at least two positions, comprising an angularly-extending surface defined by the protrusion and adapted to engage the pin during the pin's approach and engagement with the slider; and means for permitting the pin to rotate in response to the pin's approach and the engagement of the pin with the angularly-extending surface, comprising a shaft connected to the pin and comprising a longitudinal axis; a bearing coupled to the shaft, wherein the shaft is adapted to rotate in a first direction about its longitudinal axis in response to the pin's approach and the engagement of the pin with the angularly-extending surface; and a cover connected to the enclosure and to which the bearing is coupled wherein the pin is adapted to approach and engage the slider in response to the closing of the cover; wherein, when the cover is closed and the pin is engaged with the slider and in the position corresponding to the one of the at least two positions of the slider, the pin is adapted to rotate and actuate the slider in response to rotation of the shaft in a second direction about its longitudinal axis; and wherein, in response to the actuation of the slider, the slider is positioned in another of the at least two positions and a circuit breaker switch is operated.

A method has been described that includes moving a device so that the device approaches and engages a slider positioned in one of at least two positions; and automatically adjusting the device to a position corresponding to the one of the at least two positions of the slider during the device's approach and engagement with the slider so that the slider remains in the one of the at least two positions; wherein the device is permitted to actuate the slider when the device is in the position corresponding to the one of the at least two positions of the slider.

A method has been described that includes engaging a slider with a switch so that the slider is positioned in one of at least two positions; moving a device so that the device approaches and engages the slider positioned in the one of the at least two positions, comprising moving a cover of an enclosure in which the slider is housed, the device being coupled to the cover and comprising a pin; automatically adjusting the device to a position corresponding to the one of the at least two positions of the slider during the device's approach and engagement with the slider so that the slider remains in the one of the at least two positions, comprising engaging the pin with an angularly-extending surface of the slider, wherein the pin rotates to a position corresponding to the one of the at least two positions of the slider in response to the device's approach and the engagement of the pin with the angularly-extending surface, and wherein the device is permitted to actuate the slider when the device is in the position corresponding to the one of the at least two positions of the slider; and actuating the slider so that the slider is positioned in another of the at least two positions after automatically adjusting the device to a position corresponding to the one of the at least two positions of the slider during the device's approach and engagement with the slider, comprising rotating the pin so that the pin cammingly engages the slider; wherein a circuit breaker switch is operated in response to actuating the slider so that the slider is positioned in the another of the at least two positions.

A system has been described that includes first and second circuit breakers positioned in a side-by-side symmetric arrangement, each of the first and second circuit breakers comprising two or more operational modes and at least one of the first and second circuit breakers comprising a button; first and second sliders engaging the first and second circuit breakers, respectively, wherein the first and second sliders are aligned with each other; and means for permitting access to the button during each of the two or more operational modes of the at least one of the first and second circuit breakers.

A system has been described that includes first and second circuit breakers positioned in a side-by-side symmetric arrangement, each of the first and second circuit breakers comprising two or more operational modes and at least one of the first and second circuit breakers comprising a button; first and second sliders engaging the first and second circuit breakers, respectively, wherein the first and second sliders are aligned with each other; and means for permitting access to the button during each of the two or more operational modes of the at least one of the first and second circuit breakers, comprising a slot in at least one of the first and second sliders, the at least one of the first and second sliders engaging the at least one of the first and second circuit breakers; means for overlapping the first and second sliders so that the first and second sliders do not interfere with one another, comprising a first end portion of the first slider, the first end portion defining a first width that is less than a first maximum width defined by the first slider; and a second end portion of the second slider, the second end portion defining a second width that is less than a second maximum width defined by the second slider; wherein the first and second end portions of the first and second sliders, respectively, overlap during each of the two or more operational modes of the at least one of the first and second circuit breakers; means for guiding the first and second end portions during relative overlapping movement between the first and second end portions; means at least partially extending in the slot for activating the button, wherein the activating means at least partially extends in the slot during each of the two or more operational modes of the at least one of the first and second circuit breakers; and means for actuating each of the first and second sliders, comprising a first device adapted to approach and engage the first slider; and a second device adapted to approach and engage the second slider; wherein the first circuit breaker is in one of the two or more operational modes of the first circuit breaker during the first device's approach; wherein the second circuit breaker is in one of the two or more operational modes of the second circuit breaker during the second device's approach; wherein the system further comprises means for automatically adjusting the first device to a position corresponding to the one of the two or more operational modes of the first circuit breaker during the first device's approach and engagement with the first slider, wherein the first device is permitted to actuate the first slider when the first device is in the position corresponding to the one of the two or more operational modes of the first circuit breaker; and means for automatically adjusting the second device to a position corresponding to the one of the two or more operational modes of the second circuit breaker during the second device's approach and engagement with the second slider, wherein the second device is permitted to actuate the second slider when the second device is in the position corresponding to the one of the two or more operational modes of the second circuit breaker; and wherein the button is able to be viewed through the slot during each of the two or more operational modes of the at least one of the first and second circuit breakers.

A method has been described that includes positioning first and second circuit breakers in a side-by-side symmetric arrangement, each of the first and second circuit breakers comprising two or more operational modes and at least one of the first and second circuit breakers comprising a button; engaging the first and second circuit breakers with first and second sliders, respectively, wherein the first and second sliders are aligned with each other after engaging the first and second circuit breakers, respectively; and permitting access to the button during each of the two or more operational modes of the at least one of the first and second circuit breakers.

A method has been described that includes positioning first and second circuit breakers in a side-by-side symmetric arrangement, each of the first and second circuit breakers comprising two or more operational modes and at least one of the first and second circuit breakers comprising a button; engaging the first and second circuit breakers with first and second sliders, respectively, wherein the first and second sliders are aligned with each other; and permitting access to the button during each of the two or more operational modes of the at least one of the first and second circuit breakers, comprising providing a slot in at least one of the first and second sliders, the at least one of the first and second sliders engaging the at least one of the first and second circuit breakers; overlapping the first and second sliders so that the first and second sliders do not interfere with one another, comprising overlapping a first end portion of the first slider with a second end portion of the second slider during each of the two or more operational modes of the at least one of the first and second circuit breakers; wherein the first end portion defines a first width that is less than a first maximum width defined by the first slider; and wherein the second end portion defines a second width that is less than a second maximum width defined by the second slider; guiding the first and second end portions during relative overlapping movement between the first and second end portions; activating the button by at least partially extending a device in the slot; and actuating each of the first and second sliders, comprising moving a first device so that the first device approaches and engages the first slider; and moving a second device so that the second device approaches and engages the second slider; wherein the first circuit breaker is in one of the two or more operational modes of the first circuit breaker during the first device's approach; wherein the second circuit breaker is in one of the two or more operational modes of the second circuit breaker during the second device's approach; wherein the method further comprises automatically adjusting the first device to a position corresponding to the one of the two or more operational modes of the first circuit breaker during the first device's approach and engagement with the first slider, wherein the first device is permitted to actuate the first slider when the first device is in the position corresponding to the one of the two or more operational modes of the first circuit breaker; and automatically adjusting the second device to a position corresponding to the one of the two or more operational modes of the second circuit breaker during the second device's approach and engagement with the second slider, wherein the second device is permitted to actuate the second slider when the second device is in the position corresponding to the one of the two or more operational modes of the second circuit breaker; and wherein the button is able to be viewed through the slot during each of the two or more operational modes of the at least one of the first and second circuit breakers.

An apparatus has been described that includes first and second circuit breakers wherein the second circuit breaker is positioned directly beneath the first circuit breaker; first and second sliders engaged with the first and second circuit breakers, respectively; and first and second operators for actuating the first and second sliders, respectively, wherein the second operator is aligned with and positioned directly beneath the first operator so that the relative positions of the first and second operators correspond to the relative positions of the first and second circuit breakers.

An apparatus has been described that includes first and second circuit breakers wherein the second circuit breaker is positioned directly beneath the first circuit breaker; first and second sliders engaged with the first and second circuit breakers, respectively; and first and second operators for actuating the first and second sliders, respectively, wherein the second operator is aligned with and positioned directly beneath the first operator so that the relative positions of the first and second operators correspond to the relative positions of the first and second circuit breakers; wherein each of the first and second operators comprises a handle, each handle comprising an angularly-extending portion so that the handle of the second operator is in a nesting arrangement with the handle of the first operator; wherein each handle is adapted to rotate to actuate the respective first or second slider and wherein the nesting arrangement permits the second handle to rotate, relative to the first handle, over at least a predetermined range of rotation; wherein each of the first and second circuit breakers comprises a switch engaged with the respective first or second slider so that the switch is operated in response to the actuation of the respective first or second slider; wherein each of the first and second operators comprises a shaft comprising a longitudinal center axis and wherein the longitudinal center axis of the shaft of the second operator extends between the first and second circuit breakers; wherein a spacing is defined between the centerline of the switch of the second circuit breaker and the longitudinal axis of the shaft of the second operator; wherein each of the first and second circuit breakers defines a width; and wherein the spacing is substantially equal to about half of the width of the second circuit breaker to accommodate a compact arrangement between the first and second circuit breakers.

An apparatus for approaching and actuating a slider engaged with a device has been described that includes a shaft comprising a longitudinal center axis about which the shaft is adapted to rotate in place; and a pin connected to the shaft, wherein the pin is adapted to rotate and engage the slider in response to the rotation of the shaft; wherein the slider translates in response to the engagement between the pin and the slider.

An apparatus for approaching and actuating a slider engaged with a circuit breaker has been described that includes a shaft comprising an external threaded connection and a longitudinal center axis about which the shaft is adapted to rotate in place; and a pin connected to the shaft and adapted to rotate in response to the rotation of the shaft, the pin comprising a base defining a diameter of about 0.352 inches, a cam lobe extending from the base and defining a radius of about 0.750 inches, wherein the cam lobe cammingly engages the slider in response to the rotation of the shaft and the slider translates in response to the camming engagement between the cam lobe and the slider, and a planar surface adapted to be positioned proximate the slider during the camming engagement between the cam lobe and the slider; a handle connected to the shaft and aligned with the pin, the handle comprising an angularly-extending portion that is adapted to be placed in a nesting arrangement with at least one other handle, wherein the nesting arrangement between the handle and the at least one other handle permits the handle to rotate over at least a predetermined range of rotation; and a bearing through which the shaft extends, the bearing comprising an internal threaded connection threadably engaged with the external threaded connection of the shaft; wherein a switch of the circuit breaker is operated in response to the translation of the slider, the switch comprising a centerline that extends in the direction of translation of the slider, wherein a predetermined distance of about 0.5 inches is defined between the longitudinal center axis of the shaft and the centerline of the switch; and wherein the predetermined range of rotation comprises a range of rotation in a first direction to place the switch in at least one position, and a range of rotation in a second direction opposing the first direction to place the switch in at least one other position.

An apparatus for approaching and actuating a slider engaged with a circuit breaker has been described that includes a shaft comprising an external threaded connection and a longitudinal center axis about which the shaft is adapted to rotate in place; and a pin connected to the shaft and adapted to rotate in response to the rotation of the shaft, the pin comprising a generally cylindrical first portion extending from the shaft in a first direction, the first portion defining a first diameter of about 0.25 inches; and a generally cylindrical second portion extending from the first portion in a second direction, the second portion defining a second diameter that is substantially equal to the first diameter; wherein the second portion cammingly engages the slider in response to the rotation of the shaft and the slider translates in response to the camming engagement between the second portion and the slider; and wherein an angle of about 150 degrees is defined between the first and second directions; a handle connected to the shaft, the handle comprising an angularly-extending portion that is adapted to be placed in a nesting arrangement with at least one other handle, wherein the nesting arrangement between the handle and the at least one other handle permits the handle to rotate over at least a predetermined range of rotation; a bearing through which the shaft extends, the bearing comprising an internal threaded connection threadably engaged with the external threaded connection of the shaft; wherein a switch of the circuit breaker is operated in response to the translation of the slider, the switch comprising a centerline that extends in the direction of translation of the slider, wherein a predetermined distance of about 1.5 inches is defined between the longitudinal center axis of the shaft and the centerline of the switch; and wherein the predetermined range of rotation comprises a range of rotation in a first direction to place the switch in at least one position, and a range of rotation in a second direction opposing the first direction to place the switch in at least one other position.

In an exemplary embodiment, one or more of the above-described sliders 32, the operators 16 and/or the operator 58 may be used in conjunction with one-pole, two-pole and/or three-pole circuit breakers, and the sliders 32 may engage intervening parts such as, for example, tie-bars, in order apply forces to the switches of the circuit breakers to operate the switches.

In several exemplary embodiments, in addition to, or instead of panelboards, one or more of the above-described parts, components, assemblies and/or systems, including the sliders 32, the operators 16, the operator 58, the panel member 30 and/or the center strip 34 may be used in conjunction with a wide variety of enclosures. In several exemplary embodiments, a wide variety of panelboards may be used, including panelboards comprising terminal housings and other components. In addition to, or instead of circuit breaker switches, one or more of the sliders 32, the operators 16 and/or the operator 58 may be used to operate switches or other components in other devices and/or systems. In several exemplary embodiments, in addition to, or instead of the nesting of the handles of the operators 16 and/or 58, other components of the operators 16 and/or 58 may be nested in order to, for example, accommodate the compact arrangement between the circuit breakers 28. In an exemplary embodiment, the pins of the operators 16 and/or 58 may be nested if, for example, the widths of the circuit breakers 28 are less than, for example, 1 inch, or any other width. In an exemplary embodiment, the pins of the operators 16 and/or 58 may include jogs or steps so that a jog of a pin of one operator 16 or 58 may nest with a jog of a pin of another operator 16 or 58.

Any spatial references, such as, for example, "upper", "lower", "above", "below", "between", "vertical", "angular", etc., are for the purpose of illustration only and do not limit the specific orientation or location of the structure described above.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although exemplary embodiments have been described in detail above, those skilled in the art will readily appreciate that many other modifications are possible in the exemplary embodiments without materially departing from the novel teachings and advantages of the present disclosure. Accordingly, all such modifications are intended to be included within the scope of this disclosure as defined in the following claims. In the claims, means-plus-function clauses are intended to cover the structures described herein as performing the recited function and not only structural equivalents, but also equivalent structures.

What is claimed is:

1. A system comprising:

a slider positioned in one of at least two positions, the slider comprising a first side and a second side opposite the first side, the first side comprising a protrusion extending therefrom, the second side configured to engage a switching mechanism;

a device adapted to approach and engage the protrusion, wherein the device comprises a pin, wherein an angularly-extending surface defined by the protrusion is adapted to engage the pin during the pin's approach and engagement with the slider; and means for automatically adjusting the device to a position corresponding to the one of the at least two positions of the slider during the device's approach and engagement with the protrusion so that the slider remains in the one of the at least two positions, wherein the device is permitted to actuate the slider when the device is in the position corresponding to the one of the at least two positions of the slider.

2. The system of claim 1 wherein, in response to the actuation of the slider, the slider is positioned in another of the at least two positions and a circuit breaker switch is operated.

3. The system of claim 1 wherein the adjusting means further comprises:

means for permitting the pin to rotate in response to the pin's approach and the engagement of the pin with the angularly-extending surface.

4. The system of claim 3 wherein the permitting means comprises:

a shaft connected to the pin and comprising a longitudinal axis; and a bearing coupled to the shaft;

wherein the shaft is adapted to rotate in a first direction about its longitudinal axis in response to the pin's approach and the engagement of the pin with the angularly-extending surface.

5. The system of claim 4 further comprising:

an enclosure in which the slider is disposed;

wherein the permitting means further comprises:

a cover connected to the enclosure and to which the bearing is coupled;

wherein the pin is adapted to approach and engage the slider in response to the closing of the cover.

6. The system of claim 5 wherein, when the cover is closed and the pin is engaged with the slider, the pin is adapted to rotate and actuate the slider in response to rotation of the shaft in a second direction about its longitudinal axis.

7. A system comprising:

a slider positioned in one of at least two positions, the slider comprising a first side and a second side opposite the first side, the first side comprising at least one protrusion extending therefrom, the second side configured to engage a switching mechanism;

an enclosure in which the slider is disposed;

a pin adapted to approach and engage the slider; and means for automatically adjusting the pin to a position corresponding to the one of the at least two positions of the slider during the pin's approach and engagement with the slider so that the slider remains in the one of the at least two positions, comprising:

an angularly-extending surface defined by the protrusion and adapted to engage the pin during the pin's approach and engagement with the slider; and means for permitting the pin to rotate in response to the pin's approach and the engagement of the pin with the angularly-extending surface, comprising:

a shaft connected to the pin and comprising a longitudinal axis;

a bearing coupled to the shaft, wherein the shaft is adapted to rotate in a first direction about its longitudinal axis in response to the pin's approach and the engagement of the pin with the angularly-extending surface; and a cover connected to the enclosure and to which the bearing is coupled wherein the pin is adapted to approach and engage the slider in response to the closing of the cover;

wherein, when the cover is closed and the pin is engaged with the slider and in the position corresponding to the one of the at least two positions of the slider, the pin is adapted to rotate and actuate the slider in response to rotation of the shaft in a second direction about its longitudinal axis; and wherein, in response to the actuation of the slider, the slider is positioned in another of the at least two positions and a circuit breaker switch is operated.

8. A system comprising:

first and second circuit breakers positioned in a side-by-side symmetric arrangement, each of the first and second circuit breakers comprising two or more operational modes and at least one of the first and second circuit breakers comprising a button;

first and second sliders, each of the first and second sliders comprising a first side and a second side opposite the first side, each first side comprising a protrusion extending therefrom, each protrusion defining an angularly-extending surface, each second side engaging the first and second circuit breakers, respectively, wherein the first and second sliders are aligned with each other;

first and second devices, each of the first and second devices comprising a pin that engages the angularly-extending surfaces of the first and second sliders, respectively; and means for permitting access to the button during each of the two or more operational modes of the at least one of the first and second circuit breakers.

9. The system of claim 8 wherein the means for permitting access comprises: means for overlapping the first and second sliders so that the first and second sliders do not interfere with one another.

10. The system of claim 9 wherein the means for permitting access further comprises: a slot in at least one of the first and second sliders, the at least one of the first and second sliders engaging the at least one of the first and second circuit breakers.

11. The system of claim 10 further comprising: means at least partially extending in the slot for activating the button, wherein the activating means at least partially extends in the slot during each of the two or more operational modes of the at least one of the first and second circuit breakers.

12. The system of claim 9 wherein the means for overlapping the first and second sliders comprises:

a first end portion of the first slider, the first end portion defining a first width that is less than a first maximum width defined by the first slider; and a second end portion of the second slider, the second end portion defining a second width that is less than a second maximum width defined by the second slider;

wherein the first and second end portions of the first and second sliders, respectively, overlap during each of the two or more operational modes of the at least one of the first and second circuit breakers.

13. The system of claim 8 further comprising: means for actuating each of the first and second sliders.

14. The system of claim 13 further comprising: means for guiding the first and second end portions during relative overlapping movement between the first and second end portions.

15. The system of claim 13 wherein the means for actuating each of the first and second sliders comprises:

a first device adapted to approach and engage the first slider; and a second device adapted to approach and engage the second slider.

16. The system of claim 15 wherein the first circuit breaker is in one of the two or more operational modes of the first circuit breaker during the first device's approach; and wherein the system further comprises:

means for automatically adjusting the first device to a position corresponding to the one of the two or more operational modes of the first circuit breaker during the first device's approach and engagement with the first slider;

wherein the first device is permitted to actuate the first slider when the first device is in the position corresponding to the one of the two or more operational modes of the first circuit breaker.

17. The system of claim 16 wherein the second circuit breaker is in one of the two or more operational modes of the second circuit breaker during the second device's approach; and wherein the system further comprises:

means for automatically adjusting the second device to a position corresponding to the one of the two or more operational modes of the second circuit breaker during the second device's approach and engagement with the second slider;

wherein the second device is permitted to actuate the second slider when the second device is in the position corresponding to the one of the two or more operational modes of the second circuit breaker.

18. A system comprising:

first and second circuit breakers positioned in a side-by-side symmetric arrangement, each of the first and second circuit breakers comprising two or more operational modes and at least one of the first and second circuit breakers comprising a button;

first and second sliders engaging the first and second circuit breakers, respectively, wherein the first and second sliders are aligned with each other; and means for permitting access to the button during each of the two or more operational modes of the at least one of the first and second circuit breakers, comprising:

a slot in at least one of the first and second sliders, the at least one of the first and second sliders engaging the at least one of the first and second circuit breakers;

means for overlapping the first and second sliders so that the first and second sliders do not interfere with one another, comprising:

a first end portion of the first slider, the first end portion defining a first width that is less than a first maximum width defined by the first slider; and a second end portion of the second slider, the second end portion defining a second width that is less than a second maximum width defined by the second slider;

wherein the first and second end portions of the first and second sliders, respectively, overlap during each of the two or more operational modes of the at least one of the first and second circuit breakers;

means for guiding the first and second end portions during relative overlapping movement between the first and second end portions;

means at least partially extending in the slot for activating the button, wherein the activating means at least partially extends in the slot during each of the two or more operational modes of the at least one of the first and second circuit breakers; and means for actuating each of the first and second sliders, comprising:

a first device adapted to approach and engage the first slider; and a second device adapted to approach and engage the second slider;

wherein the first circuit breaker is in one of the two or more operational modes of the first circuit breaker during the first device's approach;

wherein the second circuit breaker is in one of the two or more operational modes of the second circuit breaker during the second device's approach;

wherein the system further comprises: means for automatically adjusting the first device to a position corresponding to the one of the two or more operational modes of the first circuit breaker during the first device's approach and engagement with the first slider, wherein the first device is permitted to actuate the first slider when the first device is in the position corresponding to the one of the two or more operational modes of the first circuit breaker; and means for automatically adjusting the second device to a position corresponding to the one of the two or more operational modes of the second circuit breaker during the second device's approach and engagement with the second slider, wherein the second device is permitted to actuate the second slider when the second device is in the position corresponding to the one of the two or more operational modes of the second circuit breaker; and wherein the button is able to be viewed through the slot during each of the two or more operational modes of the at least one of the first and second circuit breakers.

19. An apparatus comprising:

first and second circuit breakers wherein the second circuit breaker is positioned directly beneath the first circuit breaker;

first and second sliders, each of the first and second sliders comprising a first side and a second side opposite the first side, each first side comprising a protrusion extending therefrom, each protrusion defining an angularly-extending surface, each second side engaged with the first and second circuit breakers, respectively;

first and second devices, each of the first and second devices comprising a pin that engages the angularly-extending surfaces of the first and second sliders, respectively; and first and second operators for actuating the first and second sliders, respectively, wherein the second operator is aligned with and positioned directly beneath the first operator so that the relative positions of the first and second operators correspond to the relative positions of the first and second circuit breakers.

20. The apparatus of claim 19 wherein each of the first and second operators comprises a handle, each handle comprising an angularly-extending portion so that the handle of the second operator is in a nesting arrangement with the handle of the first operator.

21. The apparatus of claim 20 wherein each handle is adapted to rotate to actuate the respective first or second slider; and wherein the nesting arrangement permits the second handle to rotate, relative to the first handle, over at least a predetermined range of rotation.

22. The apparatus of claim 19 wherein each of the first and second circuit breakers comprises a switch engaged with the respective first or second slider so that the switch is operated in response to the actuation of the respective first or second slider.

23. The apparatus of claim 22 wherein each of the first and second operators comprises a shaft comprising a longitudinal center axis; and wherein the longitudinal center axis of the shaft of the second operator extends between the first and second circuit breakers.

24. The apparatus of claim 23 wherein a spacing is defined between the centerline of the switch of the second circuit breaker and the longitudinal axis of the shaft of the second operator.

25. The apparatus of claim 24 wherein each of the first and second circuit breakers defines a width; and wherein the spacing is substantially equal to about half of the width of the second circuit breaker to accommodate a compact arrangement between the first and second circuit breakers.

26. The apparatus of claim 19 wherein each of the first and second operators comprises:

a shaft comprising a longitudinal center axis about which the shaft is adapted to rotate in place; and a pin connected to the shaft, wherein the pin is adapted to rotate and engage the slider in response to the rotation of the shaft;

wherein the slider translates in response to the engagement between the pin and the slider.

27. The apparatus of claim 26 wherein each of the first and second sliders comprises:

first and second end portions;

a middle portion extending between the first and second end portions; and first and second protrusions extending from the middle portion, each of the first and second protrusions defining:

an angularly-extending surface; and first and second side surfaces, each of the first and second side surfaces extending from the middle portion and to the angularly-extending surface.

28. The apparatus of claim 27 wherein the pins of the first and second operators are adapted to engage at least one of the first and second protrusions of the respective first and second sliders to actuate the respective first and second sliders.

29. An apparatus comprising:

first and second circuit breakers wherein the second circuit breaker is positioned directly beneath the first circuit breaker;

first and second sliders engaged with the first and second circuit breakers, respectively; and first and second operators for actuating the first and second sliders, respectively, wherein the second operator is aligned with and positioned directly beneath the first operator so that the relative positions of the first and second operators correspond to the relative positions of the first and second circuit breakers;

wherein each of the first and second operators comprises a handle, each handle comprising an angularly-extending portion so that the handle of the second operator is in a nesting arrangement with the handle of the first operator;

wherein each handle is adapted to rotate to actuate the respective first or second slider and wherein the nesting arrangement permits the second handle to rotate, relative to the first handle, over at least a predetermined range of rotation;

wherein each of the first and second circuit breakers comprises a switch engaged with the respective first or second slider so that the switch is operated in response to the actuation of the respective first or second slider;

wherein each of the first and second operators comprises a shaft comprising a longitudinal center axis and wherein the longitudinal center axis of the shaft of the second operator extends between the first and second circuit breakers;

wherein a spacing is defined between the centerline of the switch of the second circuit breaker and the longitudinal axis of the shaft of the second operator;

wherein each of the first and second circuit breakers defines a width; and wherein the spacing is substantially equal to about half of the width of the second circuit breaker to accommodate a compact arrangement between the first and second circuit breakers.

30. An apparatus for approaching and actuating a slider engaged with a device, the apparatus comprising:

a shaft comprising a longitudinal center axis about which the shaft is adapted to rotate in place; and a pin connected to the shaft, wherein the pin is adapted to rotate and engage the slider in response to the rotation of the shaft;

wherein the slider translates in response to the engagement between the pin and an angularly-extending surface defined by a protrusion on the slider.

31. The apparatus of claim 30 wherein the device is a circuit breaker and a switch of the circuit breaker is operated in response to the translation of the slider.

32. The apparatus of claim 30 wherein the pin comprises: a base defining a diameter; and a cam lobe extending from the base and defining a radius, wherein the cam lobe cammingly engages the slider in response to the rotation of the shaft.

33. The apparatus of claim 32 wherein the device is a circuit breaker and a switch of the circuit breaker is operated in response to the translation of the slider; and wherein the shaft is permitted to rotate over at least a predetermined range of rotation comprising:

a range of rotation in a first direction to place the switch in at least one position; and a range of rotation in a second direction opposing the first direction to place the switch in at least one other position.

34. The apparatus of claim 30 wherein the pin comprises:

a generally cylindrical first portion extending from the shaft in a first direction, the first portion defining a first diameter; and a generally cylindrical second portion extending from the first portion in a second direction, the second portion defining a second diameter;

wherein the second portion cammingly engages the slider in response to the rotation of the shaft; and wherein an angle is defined between the first and second directions.

35. The apparatus of claim 34 wherein the device is a circuit breaker and a switch of the circuit breaker is operated in response to the translation of the slider; and wherein the shaft is permitted to rotate over at least a predetermined range of rotation comprising: a range of rotation in a first direction to place the switch in at least one position; and a range of rotation in a second direction opposing the first direction to place the switch in at least one other position.

36. The apparatus of claim 30 further comprising: a handle connected to the shaft.

37. The apparatus of claim 36 wherein the handle comprises an angularly-extending portion that is adapted to be placed in a nesting arrangement with at least one other handle; and wherein the nesting arrangement between the handle and the at least one other handle permits the handle to rotate over at least a predetermined range of rotation.

38. An apparatus for approaching and actuating a slider engaged with a circuit breaker, the apparatus comprising:

a shaft comprising an external threaded connection and a longitudinal center axis about which the shaft is adapted to rotate in place; and a pin connected to the shaft and adapted to rotate in response to the rotation of the shaft, the pin comprising:

a base defining a diameter of about 0.352 inches, a cam lobe extending from the base and defining a radius of about 0.750 inches, wherein the cam lobe cammingly engages the slider in response to the rotation of the shaft and the slider translates in response to the camming engagement between the cam lobe and the slider, and a planar surface adapted to be positioned proximate the slider during the camming engagement between the cam lobe and the slider;

a handle connected to the shaft and aligned with the pin, the handle comprising an angularly-extending portion that is adapted to be placed in a nesting arrangement with at least one other handle, wherein the nesting arrangement between the handle and the at least one other handle permits the handle to rotate over at least a predetermined range of rotation; and a bearing through which the shaft extends, the bearing comprising an internal threaded connection threadably engaged with the external threaded connection of the shaft;

wherein a switch of the circuit breaker is operated in response to the translation of the slider, the switch comprising a centerline that extends in the direction of translation of the slider, wherein a predetermined distance of about 0.5 inches is defined between the longitudinal center axis of the shaft and the centerline of the switch; and wherein the predetermined range of rotation comprises:

a range of rotation in a first direction to place the switch in at least one position, and a range of rotation in a second direction opposing the first direction to place the switch in at least one other position.

39. An apparatus for approaching and actuating a slider engaged with a circuit breaker, the apparatus comprising:

a shaft comprising an external threaded connection and a longitudinal center axis about which the shaft is adapted to rotate in place; and a pin connected to the shaft and adapted to rotate in response to the rotation of the shaft, the pin comprising:

a generally cylindrical first portion extending from the shaft in a first direction, the first portion defining a first diameter of about 0.25 inches; and a generally cylindrical second portion extending from the first portion in a second direction, the second portion defining a second diameter that is substantially equal to the first diameter;

wherein the second portion cammingly engages the slider in response to the rotation of the shaft and the slider translates in response to the camming engagement between the second portion and the slider; and wherein an angle of about 150 degrees is defined between the first and second directions;

a handle connected to the shaft, the handle comprising an angularly-extending portion that is adapted to be placed in a nesting arrangement with at least one other handle, wherein the nesting arrangement between the handle and the at least one other handle permits the handle to rotate over at least a predetermined range of rotation;

a bearing through which the shaft extends, the bearing comprising an internal threaded connection threadably engaged with the external threaded connection of the shaft;

wherein a switch of the circuit breaker is operated in response to the translation of the slider, the switch comprising a centerline that extends in the direction of translation of the slider, wherein a predetermined distance of about 1.5 inches is defined between the longitudinal center axis of the shaft and the centerline of the switch; and wherein the predetermined range of rotation comprises:

a range of rotation in a first direction to place the switch in at least one position, and a range of rotation in a second direction opposing the first direction to place the switch in at least one other position.

* * * * *